US007387602B1

(12) United States Patent
Kirsch

(10) Patent No.: US 7,387,602 B1
(45) Date of Patent: Jun. 17, 2008

(54) APPARATUS FOR CENTRIFUGING A SLURRY

(75) Inventor: Raymond Kirsch, Java Center, NY (US)

(73) Assignee: Derrick Corporation, Buffalo, NY (US)

( * ) Notice: Subject to any disclaimer, the term of this patent is extended or adjusted under 35 U.S.C. 154(b) by 0 days.

(21) Appl. No.: 11/093,959

(22) Filed: Mar. 30, 2005

Related U.S. Application Data

(63) Continuation of application No. 10/138,202, filed on May 3, 2002, now Pat. No. 6,971,982, which is a continuation-in-part of application No. 10/133,889, filed on Apr. 26, 2002, now Pat. No. 6,905,452.

(51) Int. Cl.
*B04B 13/00* (2006.01)
*B04B 1/20* (2006.01)

(52) U.S. Cl. ..... 494/8; 494/53; 700/273

(58) Field of Classification Search ..... 494/1, 494/5, 7–10, 12, 27, 30, 42, 52–54, 84; 210/97, 210/103, 134, 143, 380.3; 700/273
See application file for complete search history.

(56) References Cited

U.S. PATENT DOCUMENTS 2,955,753 A * 10/1960 O'Conor et al. ..... 494/5
3,228,594 A * 1/1966 Amero ..... 494/23
3,494,542 A * 2/1970 Finkelston et al. ..... 494/7
4,070,290 A * 1/1978 Crosby ..... 210/91
4,073,431 A 2/1978 Jager
4,228,949 A * 10/1980 Jackson ..... 494/2
4,240,578 A * 12/1980 Jackson ..... 494/8
4,303,192 A * 12/1981 Katsume ..... 494/9
4,421,502 A * 12/1983 Jakobs ..... 494/7
4,432,747 A * 2/1984 Posse et al. ..... 494/8
4,668,213 A * 5/1987 Kramer ..... 494/8
5,178,455 A * 1/1993 Ohsaki et al. ..... 366/6
5,203,762 A 4/1993 Cooperstein
5,282,780 A 2/1994 Epper et al.
5,403,260 A * 4/1995 Hensley ..... 494/53
5,529,566 A * 6/1996 Weil ..... 494/1

(Continued)

FOREIGN PATENT DOCUMENTS

DE 2525280 A1 * 12/1976

(Continued)

*Primary Examiner*—Charles E Cooley
(74) *Attorney, Agent, or Firm*—Simpson & Simpson, PLLC

(57) ABSTRACT

A method and apparatus for centrifuging. The apparatus comprises a centrifuge for centrifuging a slurry, comprising a bowl driven by a bowl drive motor, a screw conveyor driven by a screw conveyor drive motor, a pump driven by a pump motor, a bowl drive unit operatively arranged to drive the bowl drive motor, a conveyor drive unit operatively arranged to drive the screw conveyor drive motor, a pump drive unit operatively arranged to drive the pump drive motor, and, a general purpose first computer specially programmed to control the bowl drive unit to drive the bowl drive motor at a first constant speed and to control the screw conveyor drive unit to drive the screw conveyor drive motor at a second constant speed and to monitor the torques of the bowl drive motor and the screw conveyor drive motor, while simultaneously controlling the pump drive unit to variably control flow of the slurry through the centrifuge so as to drive one of the bowl drive motor or the screw conveyor motor at a pre-set operating torque.

15 Claims, 37 Drawing Sheets

U.S. PATENT DOCUMENTS 5,681,256 A * 10/1997 Nagafuji ..... 494/9
5,714,858 A * 2/1998 Pieralisi ..... 318/539
5,857,955 A * 1/1999 Phillips et al. ..... 494/5
5,865,718 A * 2/1999 Chan ..... 494/10
5,919,123 A * 7/1999 Phillips ..... 494/7
5,948,271 A * 9/1999 Wardwell et al. ..... 210/739
6,328,897 B1 * 12/2001 Leung ..... 210/744
6,368,264 B1 * 4/2002 Phillips et al. ..... 494/5
6,593,143 B1 * 7/2003 Gordon ..... 436/45
6,860,845 B1 * 3/2005 Miller et al. ..... 494/1
6,905,452 B1 * 6/2005 Kirsch ..... 494/8
6,971,982 B1 * 12/2005 Kirsch ..... 494/8
6,981,940 B2 * 1/2006 Rafferty ..... 494/7
2004/0138040 A1 * 7/2004 Hensley et al. ..... 494/53
2004/0259710 A1 * 12/2004 Rafferty ..... 494/15

FOREIGN PATENT DOCUMENTS

FR 2547416 * 12/1984
JP 4-290562 * 10/1992

* cited by examiner

VFD CENTRIFUGE CONTROL SCHEME

Main Program

Data Conversion and Averaging Subroutine

APPARATUS FOR CENTRIFUGING A SLURRY

RELATED APPLICATION

This is a continuation patent application under 35 USC 120 which claims the benefit of U.S. patent application Ser. No. 10/138,202, filed May 3, 2002, entitled, "APPARATUS FOR CENTRIFUGING A SLURRY." U.S. patent application Ser. No. 10/138,202 is a continuation-in-part patent application under 35 USC 120 which claims the benefit of U.S. patent application Ser. No. 10/133,889, filed Apr. 26, 2002, entitled, "APPARATUS FOR CENTRIFUGING A SLURRY." U.S. patent application Ser. No. 10/133,889 and U.S. patent application Ser. No. 10/138,202 are incorporated by reference herein. U.S. patent application Ser. No. 10/133,889 issued as U.S. Pat. No. 6,905,452, on Jun. 14, 2005. U.S. patent application Ser. No. 10/138,202 issued as U.S. Pat. No. 6,971,982, on Dec. 6, 2005.

REFERENCE TO COMPUTER PROGRAM LISTING APPENDIX

This patent includes a computer program listing appendix on compact disc. Two duplicate compact discs are provided herewith. Each compact disc contains a computer program listing as follows:

Filename: DERP101_US.txt Computer Program Listing

Size: 89 KB

Date Created Apr. 26, 2002

The computer program listing appendix is hereby expressly incorporated by reference in the present application.

FIELD OF THE INVENTION

The present invention relates generally to a method and apparatus for centrifuging and, more particularly, to a method and apparatus for centrifuging which inherently and automatically safeguards against overloading the centrifuge, while maintaining efficient and effective centrifuging operation.

BACKGROUND OF THE INVENTION

One well-known type of centrifuge comprises a bowl and screw conveyor, each of which is driven by an electric motor. A danger in operating this type of centrifuge in some applications is that one or both of the motors may be presented with a load that will require the motor(s) to exceed rated torque. This could lead to motor failure and machine overload, in some circumstances, and to system shutdown. In some applications, such as oil well drilling, for example, down-time caused by centrifuge failure could be extremely expensive. One obvious solution to this problem known in the art is to simply monitor motor torque and shut down the entire system when overload occurs. Another known solution is to simply shut off the feed pump (which supplies a slurry to the centrifuge for separation) when overload occurs. Both of these known solutions are unsatisfactory, however, as they both adversely affect overall system performance and/or efficiency. In a solution to this problem in the parent patent of which this patent claims priority, predetermined limits were imposed on operating torque of both the conveyor and bowl motors. A drawback of this solution, however, is that the operator had no control over the predetermined torque limits and, under some operating conditions, the operator might want to run the motors within different limits. Another problem in existing centrifuge systems is that some users/operators have existing pump/gear box assemblies that they would like to use with a newly installed centrifuge. Heretofore, this was not possible, because the computer controlled centrifuges were not programmed to run with third party (i.e., other than OEM) pumps. What is needed, then, is a method and apparatus for centrifuging which continuously monitors motor torques, permits operators to preset torque limits for conveyor and bowl motors, adjusts centrifuge operation automatically as load conditions change to ensure safe motor operation and efficient system operation, and can be used with customers' existing feed pumps.

SUMMARY OF THE INVENTION

The invention broadly comprises a method and apparatus for centrifuging. In one embodiment, the apparatus comprises a centrifuge for centrifuging a slurry, comprising a bowl driven by a bowl drive motor, a screw conveyor driven by a screw conveyor drive motor, a pump driven by a pump motor, a bowl drive unit operatively arranged to drive the bowl drive motor, a conveyor drive unit operatively arranged to drive the screw conveyor drive motor, a pump drive unit operatively arranged to drive the pump drive motor, and, a general purpose first computer specially programmed to control the bowl drive unit to drive the bowl drive motor at a first constant speed and to control the screw conveyor drive unit to drive the screw conveyor drive motor at a second constant speed and to monitor the torques of the bowl drive motor and the screw conveyor drive motor, while simultaneously controlling the pump drive unit to variably control flow of the slurry through the centrifuge so as to drive one of the bowl drive motor or the screw conveyor motor at a pre-set operating torque.

In a second embodiment, the centrifuge comprises a bowl driven by a bowl drive motor, a screw conveyor driven by a screw conveyor drive motor, a pump driven by a pump motor through a gear box having a gear box ratio and known pump output rate per revolution, a bowl drive unit operatively arranged to drive the bowl drive motor, a conveyor drive unit operatively arranged to drive the screw conveyor drive motor, a pump drive unit operatively arranged to drive the pump drive motor, and, a general purpose first computer specially programmed to control the pump drive unit to variably control flow of the slurry through the centrifuge in accordance with the gear box ratio and known pump output rate per revolution until such time as the load of the slurry causes one of the bowl drive motor or the screw conveyor motor to exceed an operator set operating torque for the bowl drive motor or the screw conveyor motor, respectively.

In a system having a centrifuge comprising a bowl and screw conveyor driven by a bowl motor and screw conveyor motor, respectively, the system also having a feed pump driven by a pump motor to provide a slurry load to be centrifuged by the centrifuge, the invention also comprises the method of controlling the system, comprising the steps of:

a. manually setting an operating torque set-point for the screw conveyor motor and the bowl motor; and, b. automatically controlling the pump motor to regulate the feed pump until the slurry load demands more than the manually set operating torque for the screw conveyor motor or the bowl motor.

In a system having a centrifuge comprising a bowl and screw conveyor driven by a bowl motor and screw conveyor motor, respectively, the system also having a feed pump driven by a pump motor through a pump gearbox having a gearbox ratio to provide a slurry load to be centrifuged by the centrifuge, the invention broadly comprises the improved method of controlling the system, comprising the steps of:

a. manually setting a feed pump gear box ratio and feed pump output rate per revolution for the feed pump;

b. manually setting an operating torque set-point for the screw conveyor motor and the bowl motor; and, c. automatically controlling the pump motor to regulate the feed pump until the slurry load demands more than the manually set operating torque for the screw conveyor motor or the bowl motor.

A general object of the invention is to provide a method and apparatus for centrifuging which protects against centrifuge shutdown due to overloading of centrifuge motors.

A secondary object of the invention is to provide a method and apparatus for centrifuging which protects against overload of centrifuge motors by regulating the pump motor which, in turn, regulates the pump feeding slurry to the centrifuge, in response to monitored conditions of torque developed by centrifuge screw conveyor and bowl motors.

A further object of the invention is to provide a method and apparatus for centrifuging which permits an operator of the system to preset maximum torque operating levels for the screw conveyor and bowl motors, regulates the centrifuge feed pump while monitoring the torques developed by both conveyor and bowl motors, and takes appropriate action when preset torque limits are exceeded by either the conveyor or bowl motor (such as shutting down the pump drive motor, shutting down the conveyor and bowl motors, or, ultimately shutting down the centrifuge system.)

Another object of the invention is to provide a centrifuge system that is configured to use a customer's or operator's existing feed pump, by permitting certain specifications of the feed pump to be entered into the control computer of the centrifuge system, thereby avoiding the need for the customer to purchase an integral pump with the system.

These and other objects, features and advantages of the present invention will become readily apparent to those having ordinary skill in the art from a reading and study of the following detailed description of the invention, in view of the drawing and appended claims.

DESCRIPTION OF THE PREFERRED EMBODIMENT

It should be appreciated at the outset that the method and apparatus of centrifuging of the invention is suitable for use in a variety of applications—virtually any application that requires a centrifuge. In a preferred embodiment of the invention, the patentee tested the invention in an earth drilling application. Thus, while the description herein describes the invention in this particular application, it should be appreciated that the appended claims are not intended to be so limited. In addition, it should be appreciated that the centrifuge of the present invention is adaptable for use in either closed or open systems.

In reading this patent, it should be appreciated that like reference numbers on different drawing views represent identical structural elements of the invention. It should also be appreciated that the centrifuge of the present invention is ultimately controlled by a general purpose industrial hardened computer specially programmed to control the bowl drive motor, the screw conveyor motor, and the pump motor. The computer also provides a user interface in the form of a monitor and is controlled through an attached pointing device (mouse). The source code running on the processor of the invention is included in the compact disc appendix, and is incorporated herein by reference.

Figure 1:
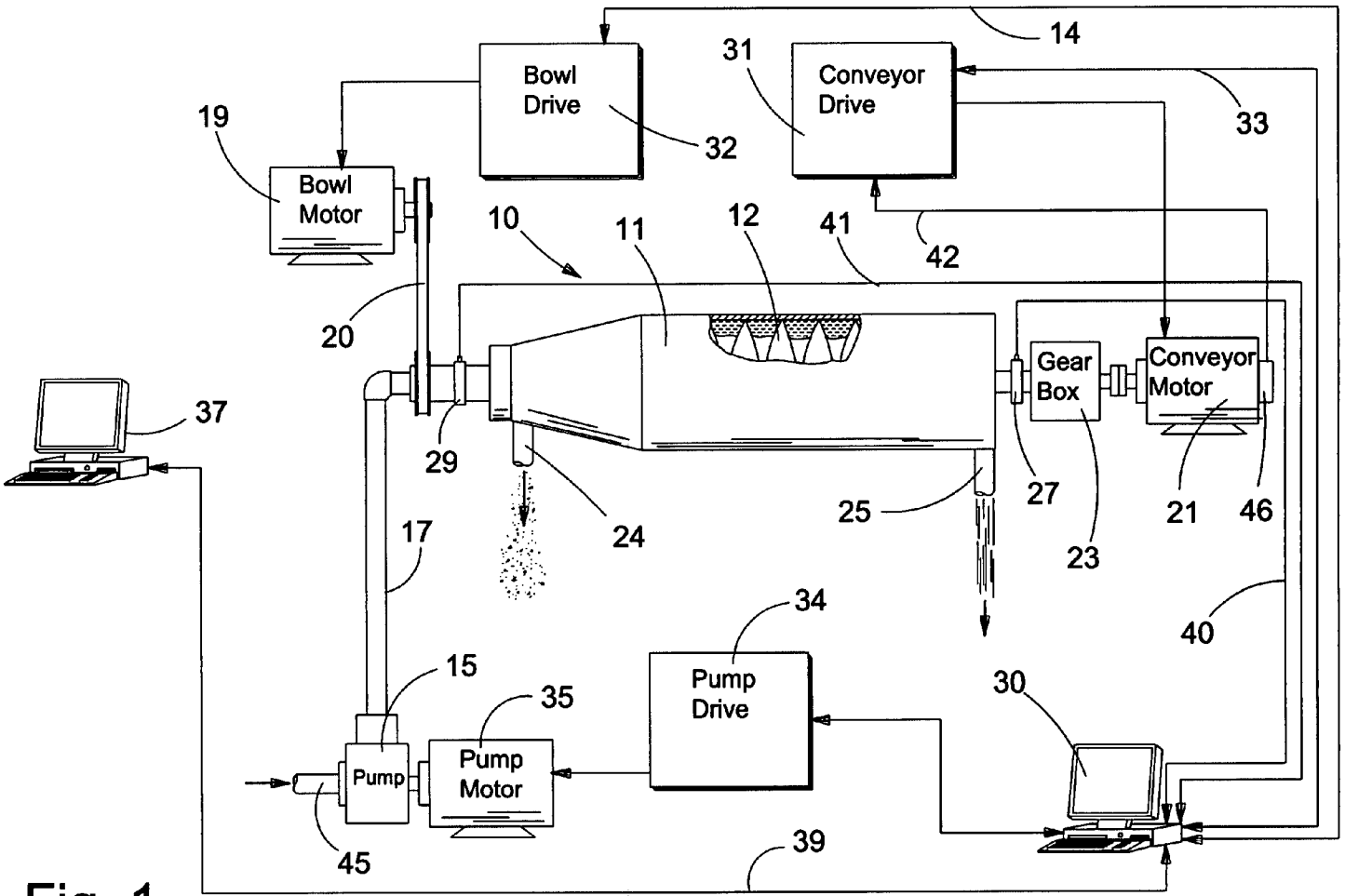
FIG. 1 is a schematic view of a centrifuge system wherein a centrifuge receives a slurry for separation and includes drives, motors, pumps and computer controls coupled thereto.
Figure 2:
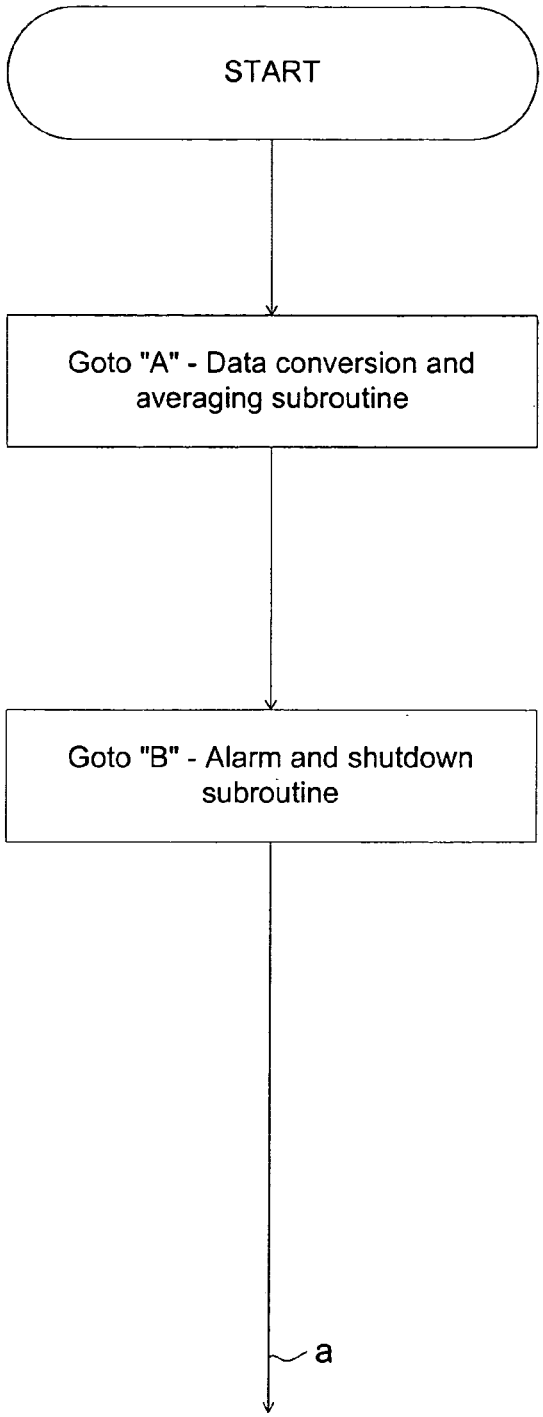
FIGS. 2-7 are flow charts depicting the logic for implementing the control of the variable frequency drive centrifuge.
Figure 3:
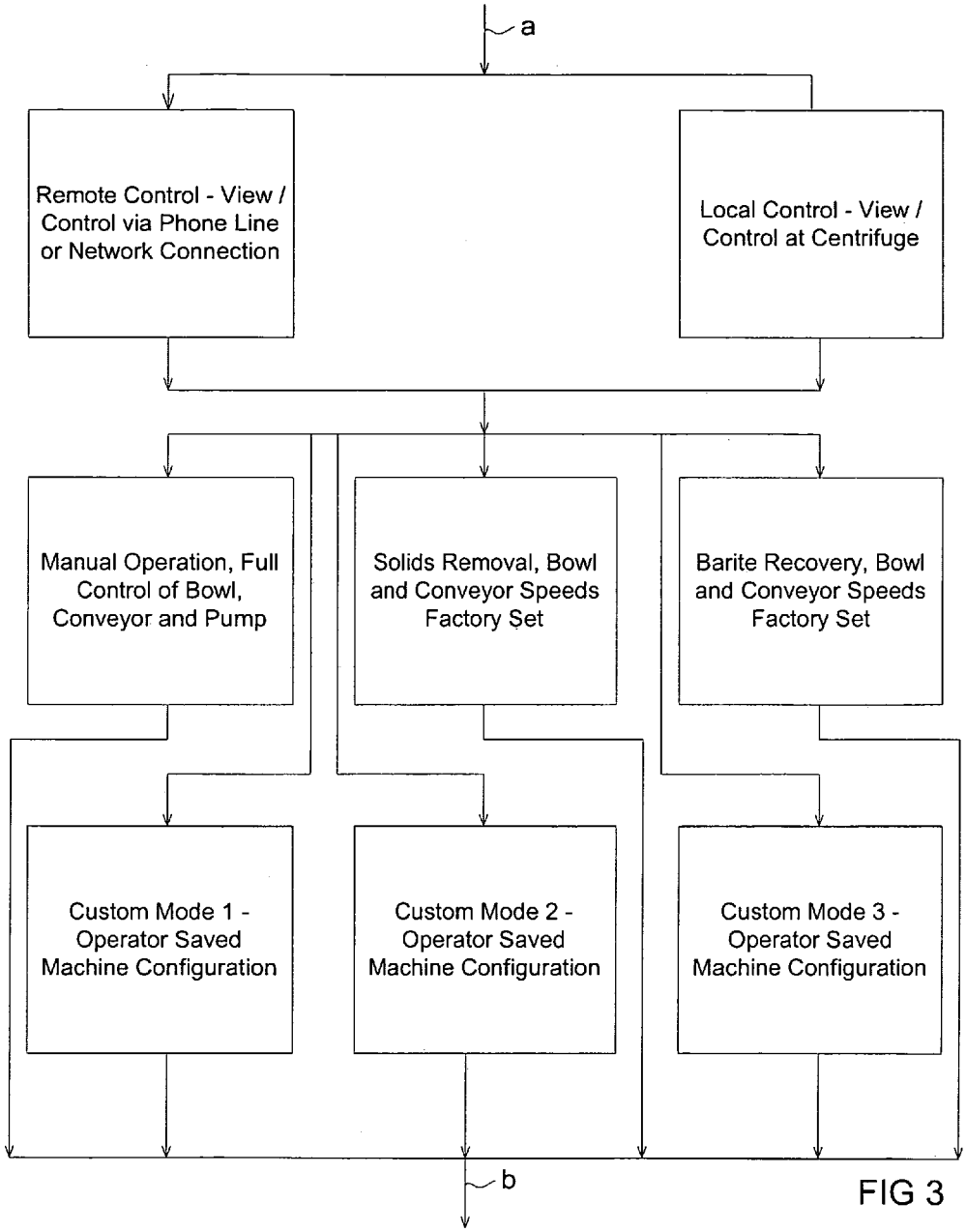
Figure 4:
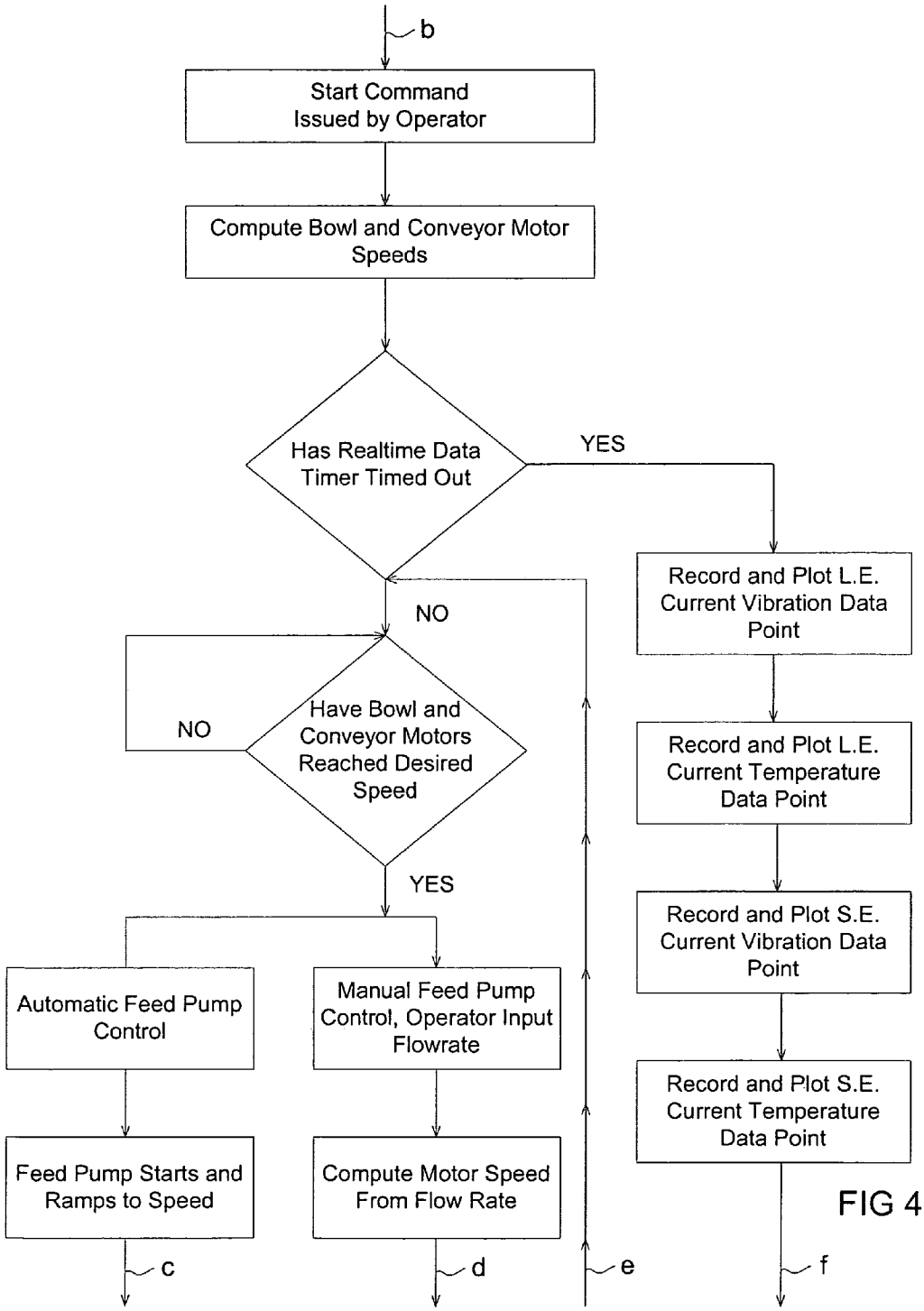
Figure 5:
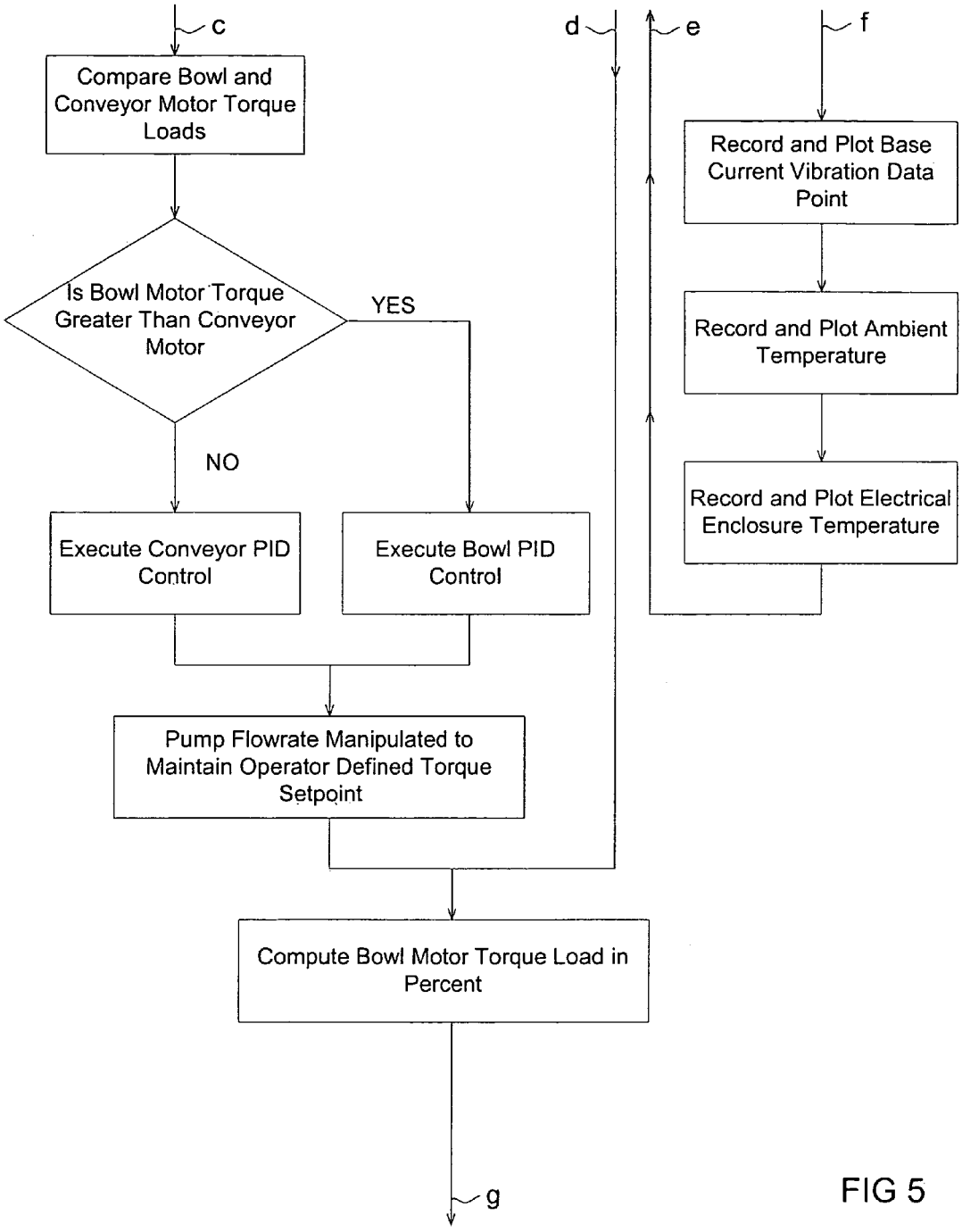
Figure 6:
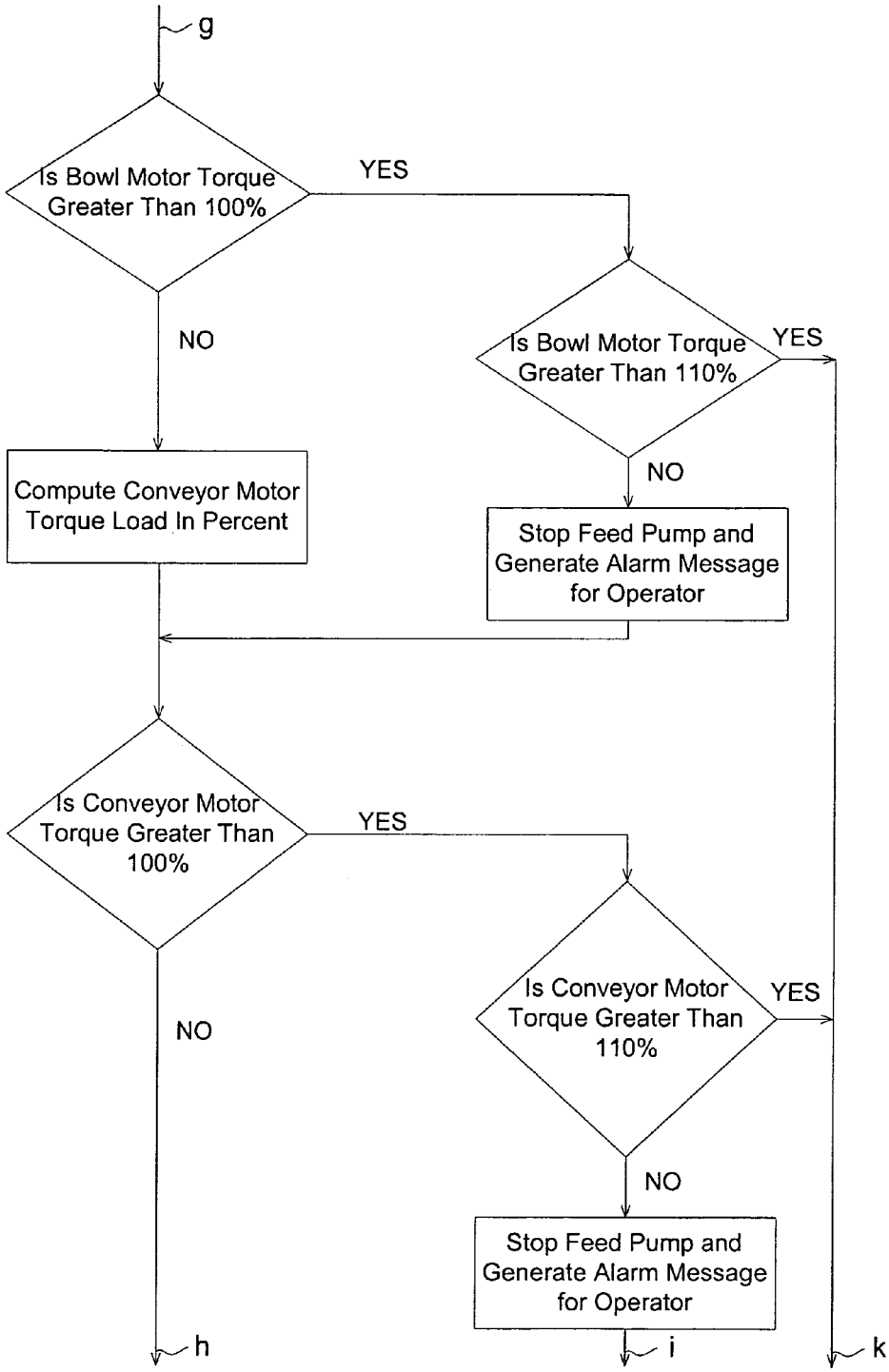
Figure 7:
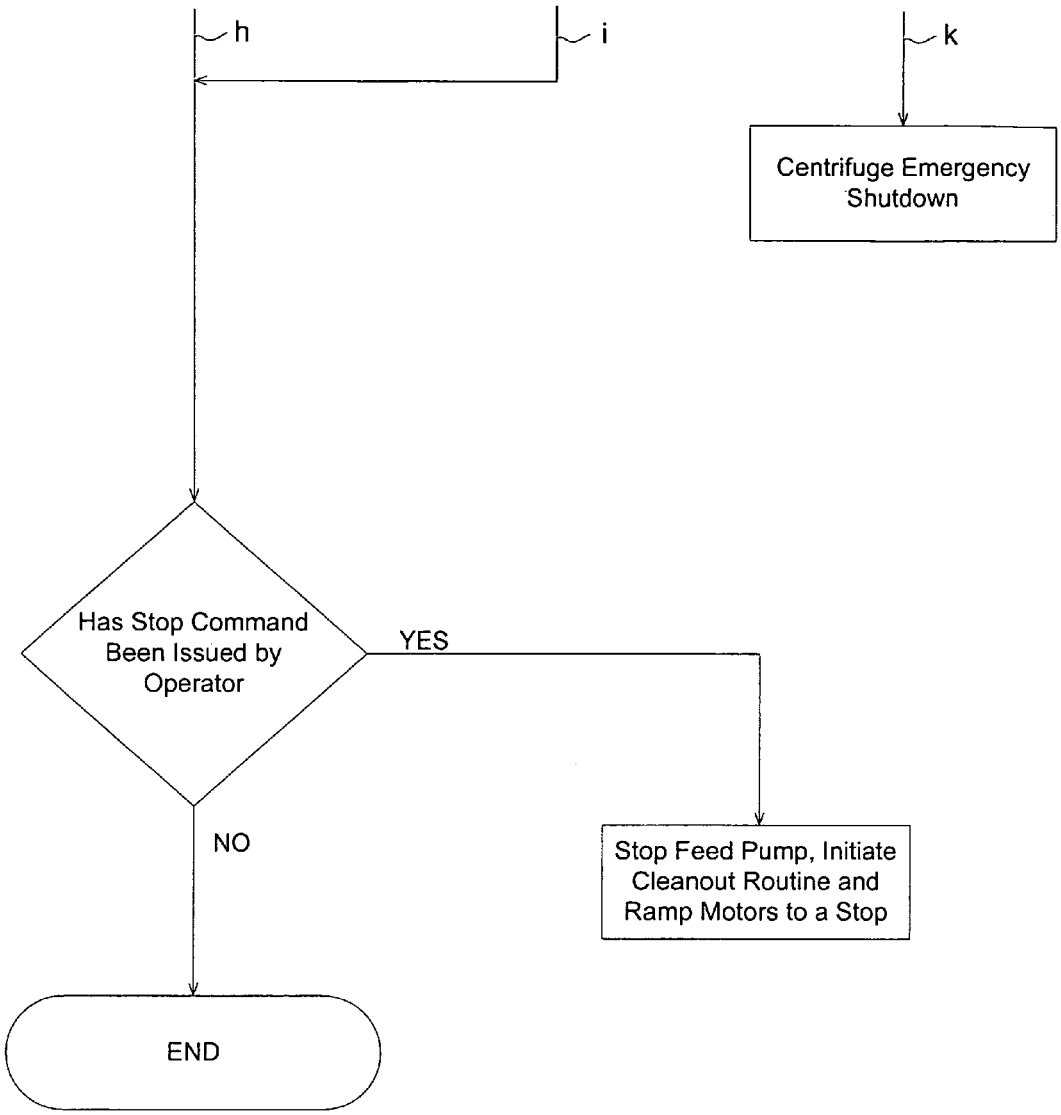
Figure 8:
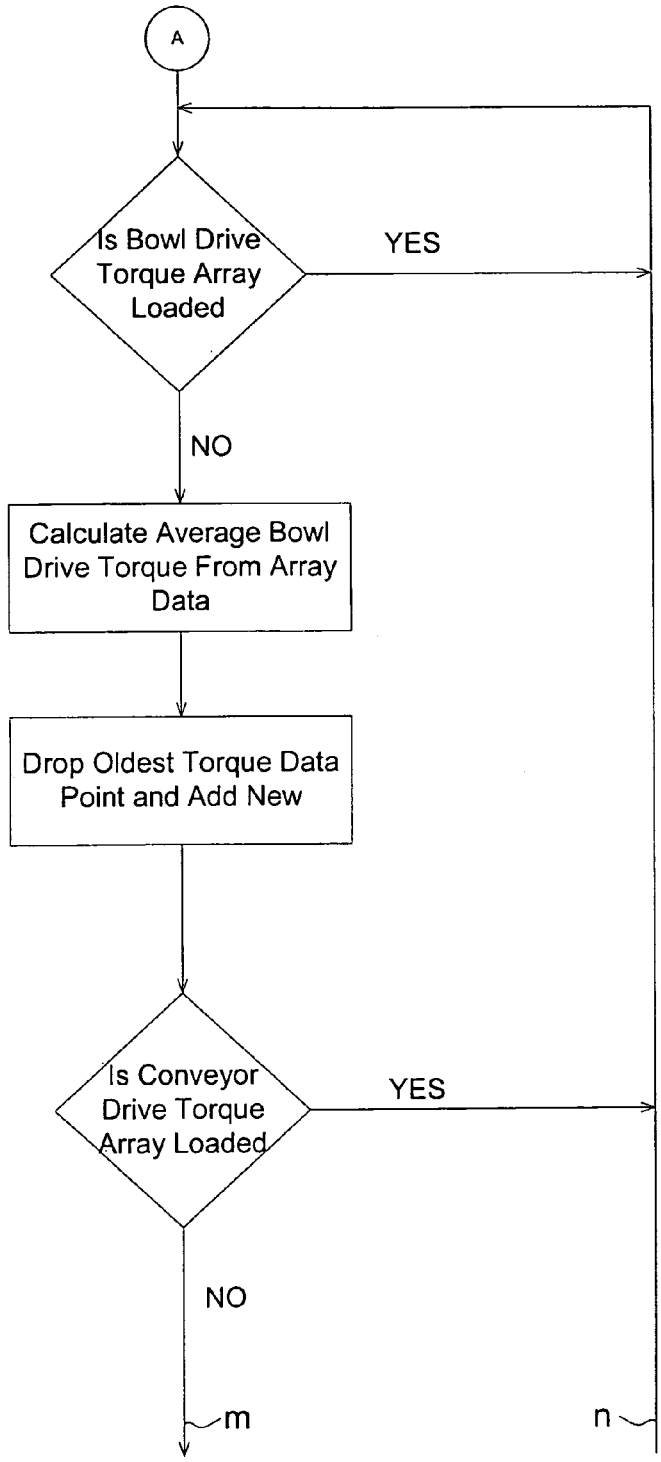
FIGS. 8-12 are flow charts illustrating the logic for the data conversion and averaging subroutine.
Figure 9:
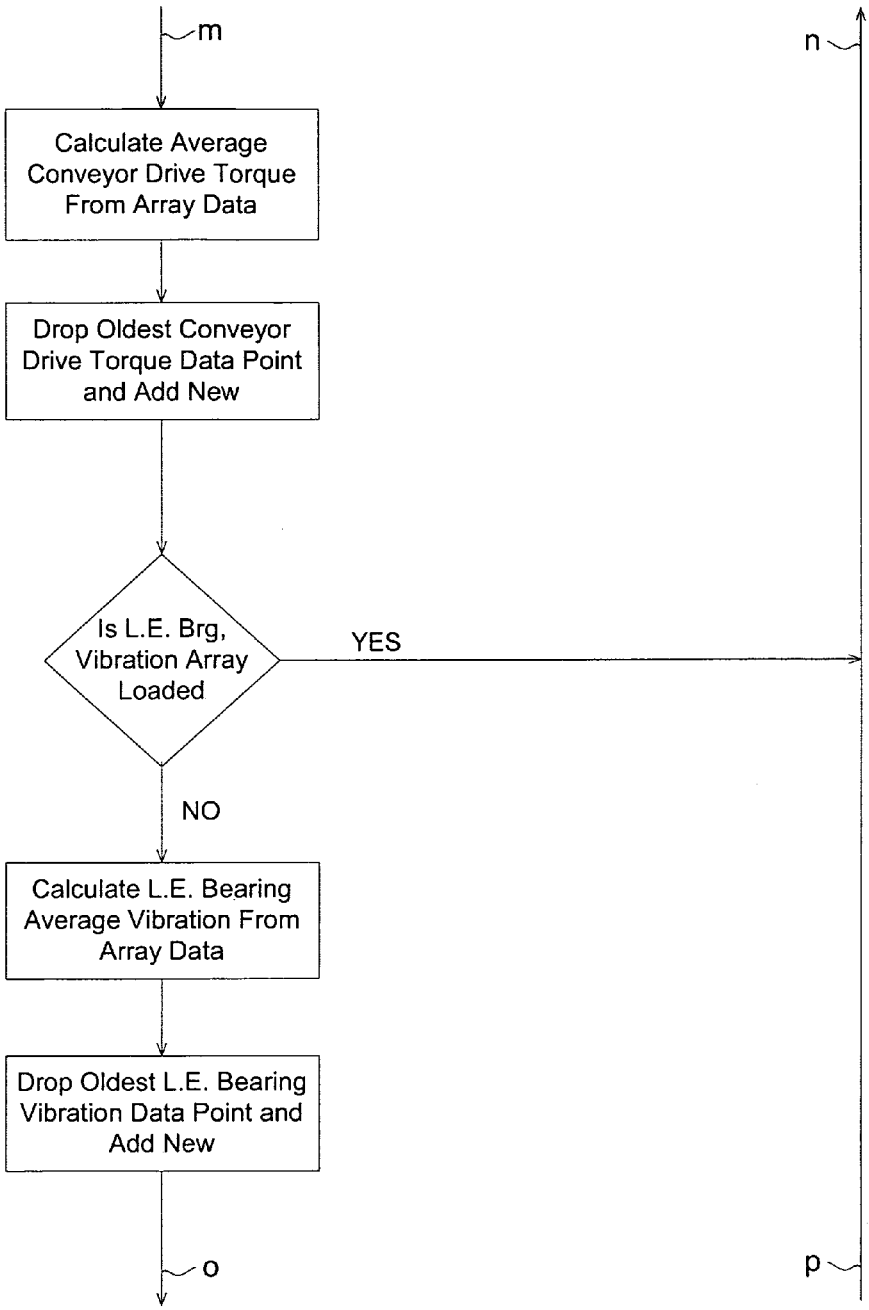
Figure 10:
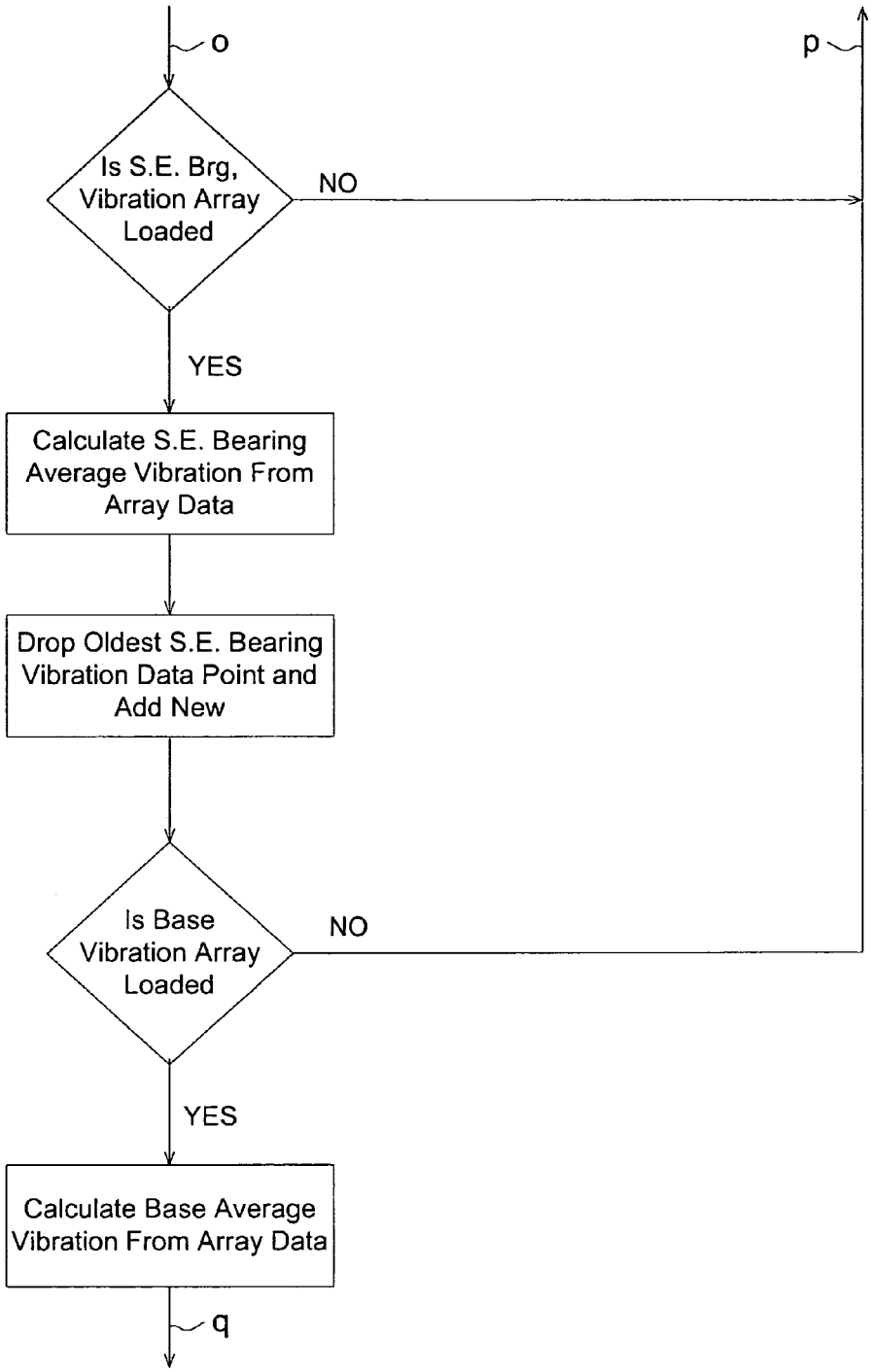
Figure 11:
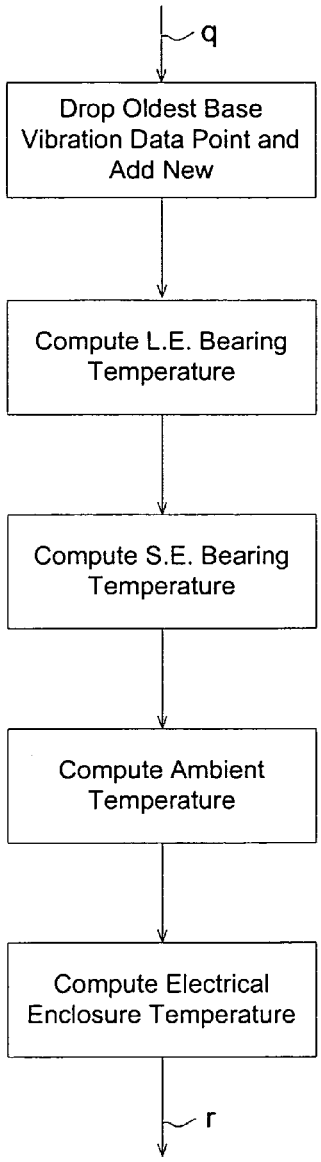
Figure 12:
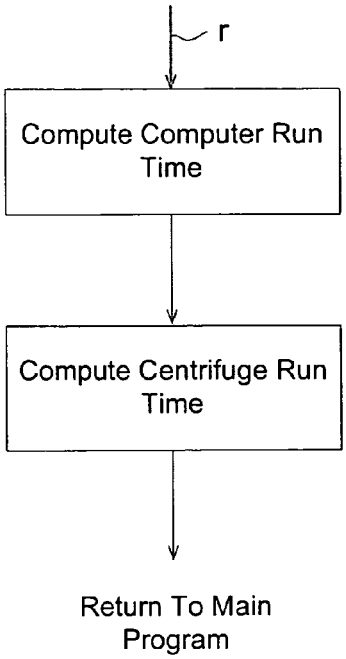
Figure 13:
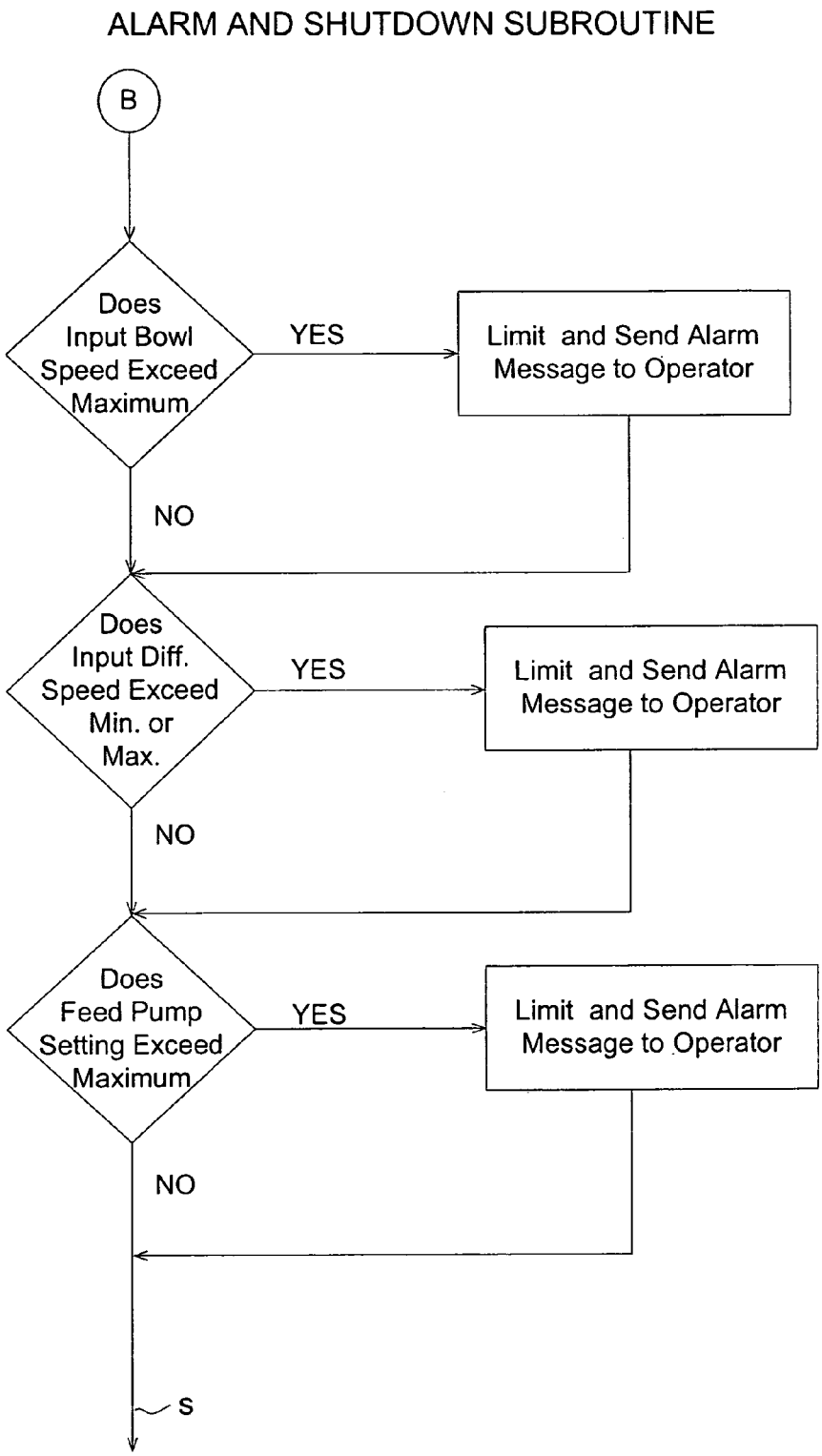
FIGS. 13-17 are flow charts illustrating the logic of the alarm and shutdown subroutine; and, FIGS. 18-37 represent screen captures illustrating the user interface with the computer control system of the invention.
Figure 14:
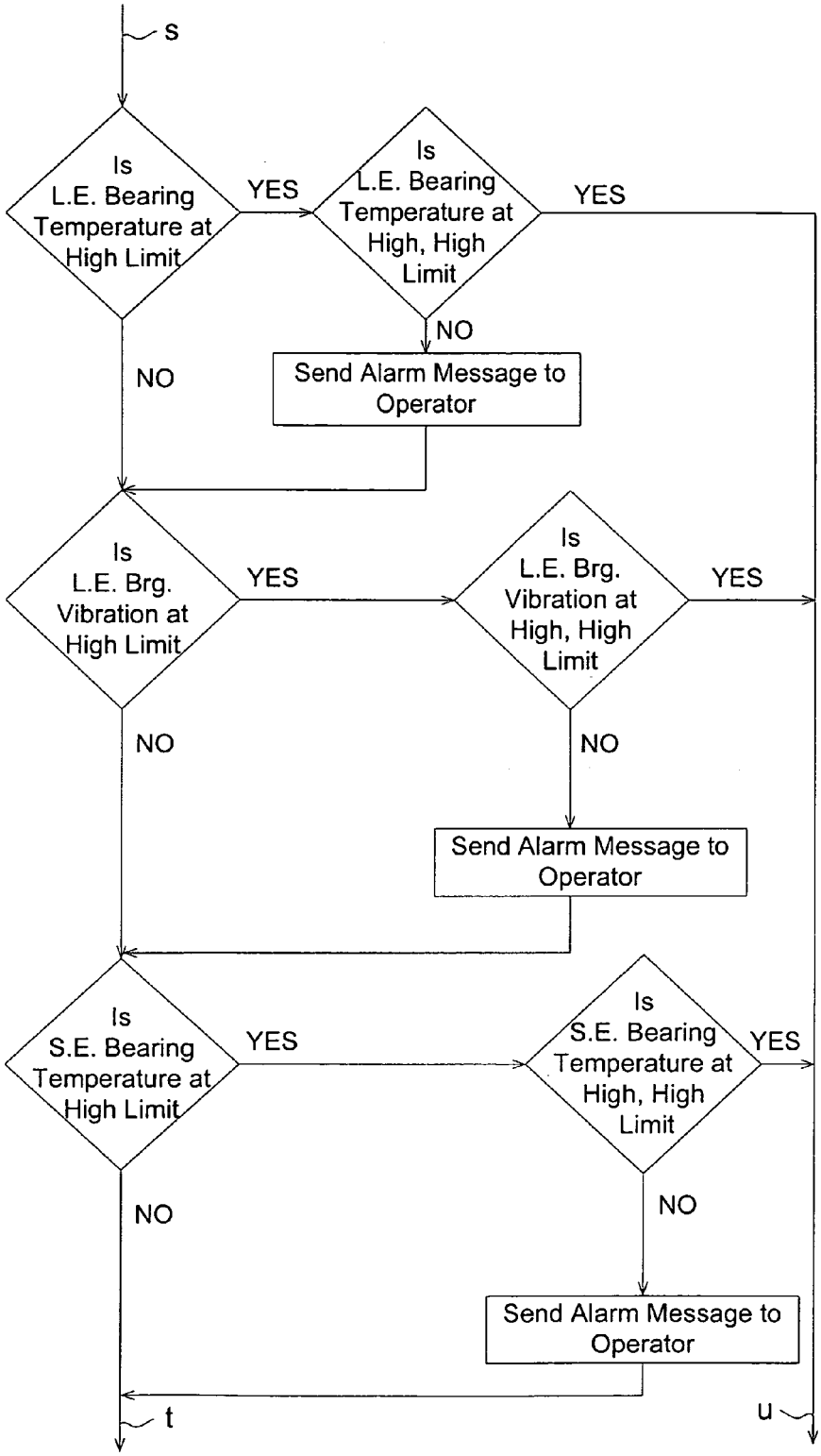
Figure 15:
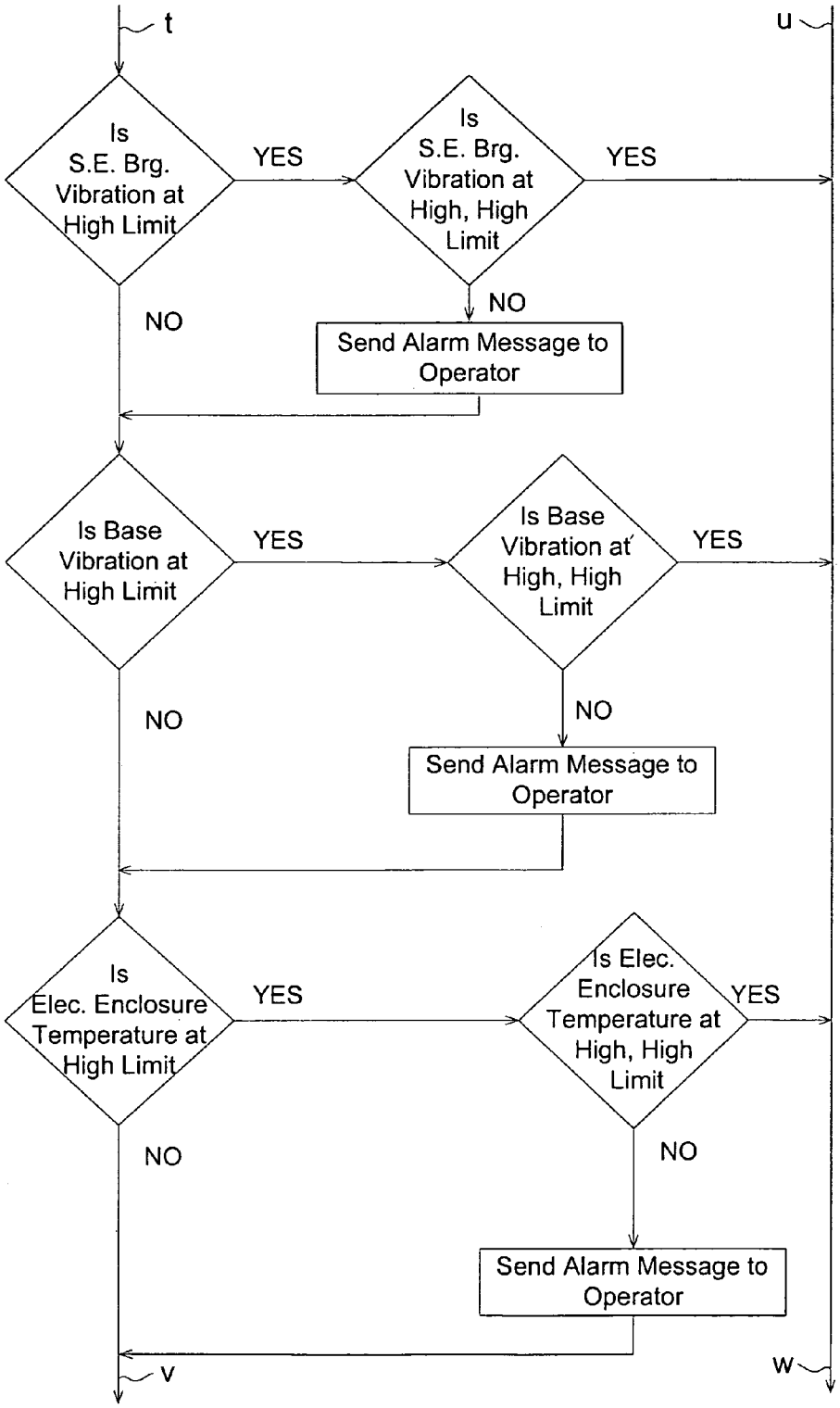
Figure 16:
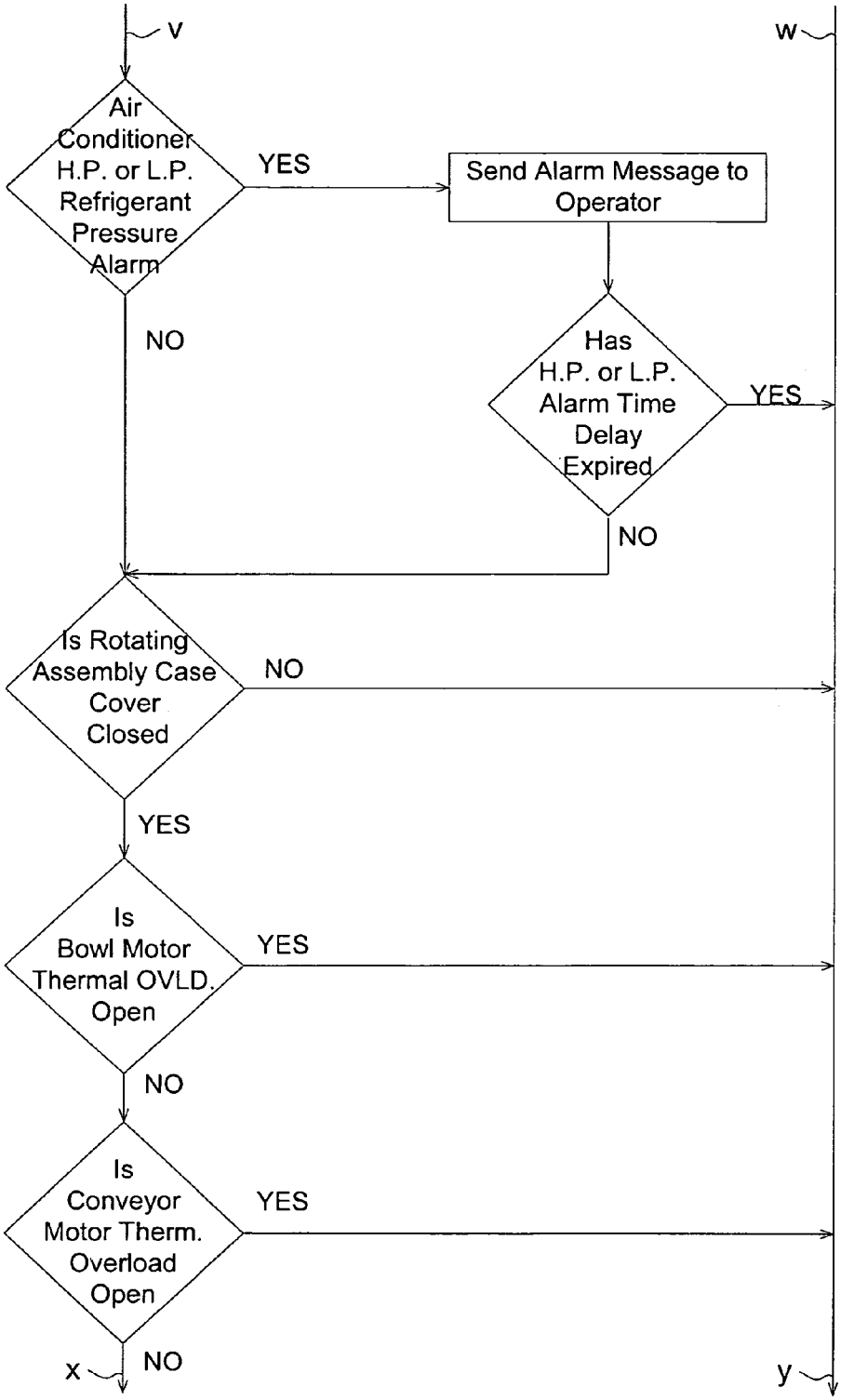
Figure 17:
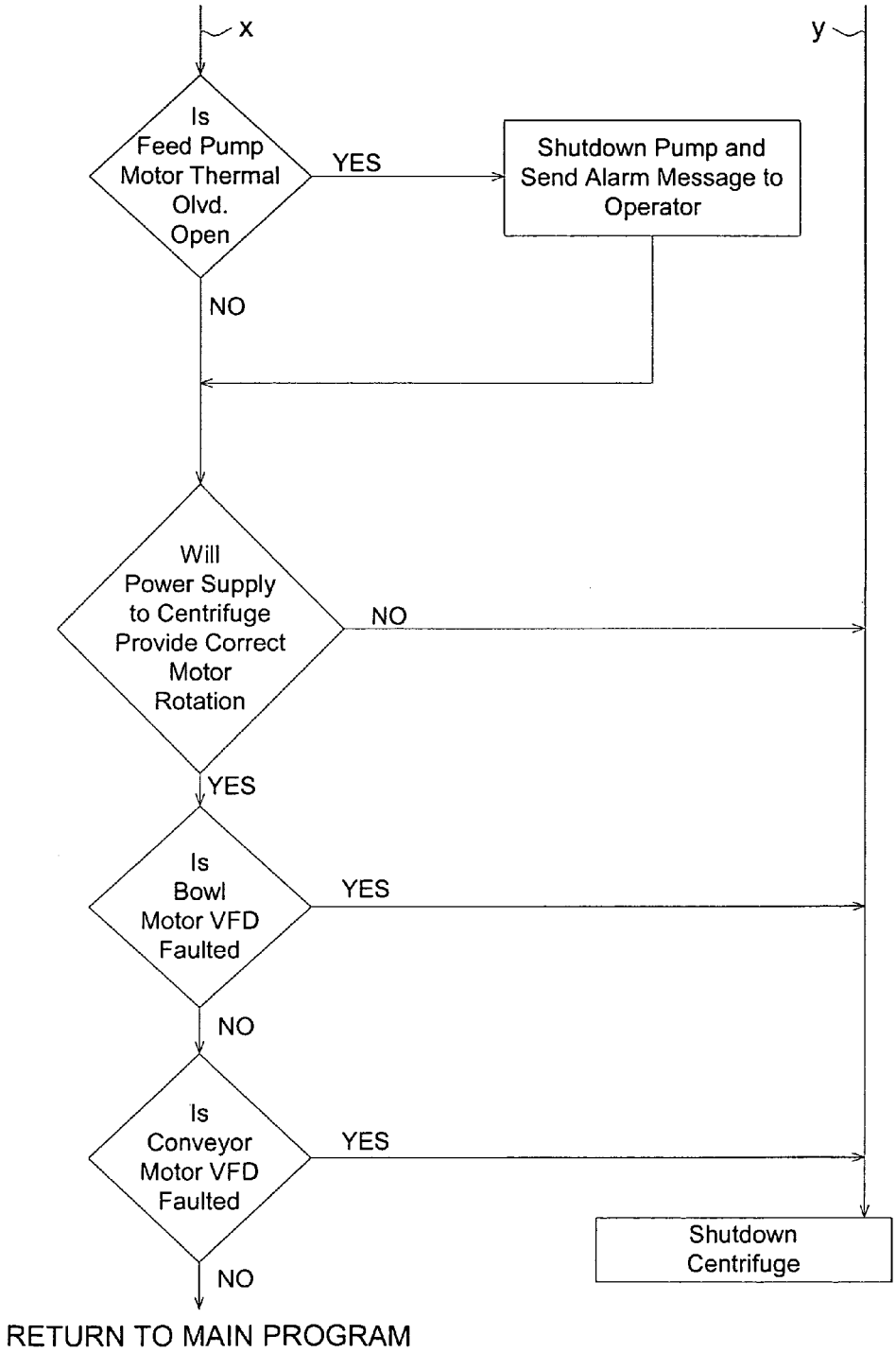

Adverting now to FIG. 1, centrifuge 10 of the inventive system includes a bowl 11 and a screw conveyor 12, the specific structure of which is well known in the art. The centrifuge 10 receives a slurry via conduit 45 into pump 15 which then pumps the slurry to the centrifuge via conduit 17. The bowl 11 is driven by bowl motor 19 via pulley arrangement 20, and screw conveyor 12 is driven by conveyor motor 21 via gear box 23. The high density solids, which are separated from the slurry, are discharged from centrifuge 10 through conduit 24. The remaining portions of the slurry (effluent) are ejected from the centrifuge via conduit 25. The bowl 11 is supported by two bearings 27 and 29. Conveyor motor speed and direction information is detected by encoder 46 and communicated to conveyor drive unit 31 via line 42.

The encoder is arranged to enable control of the screw conveyor drive motor to operate the conveyor within a differential speed range. This control is implemented using the source code. A description of the portions of the source code applicable to the speed range of the conveyor is as follows.

Rung 10

A comparison is made to determine if the bowl speed is less-than a threshold or greater-than-or-equal-to the threshold. With bowl speeds less-than the threshold, a new maximum differential speed is calculated. With bowl speeds greater-than-or-equal-to the threshold, the full differential speed range is available to the operator. The threshold and the differential speed range are related to the maximum speed rating of the conveyor motor as defined near the end of Rung 10. For example, a 1600 RPM threshold (bowl speed) with a conveyor differential speed of 100 RPM requires the conveyor drive motor to run at 3600 RPM in the reverse direction.

Rung 11

If the desired conveyor differential speed requires the conveyor motor speed to be greater-than-or-equal-to zero RPM, conveyor motor direction is forward.

Rung 12

If the desired conveyor differential speed requires the conveyor motor speed to be less-than zero RPM, conveyor motor direction is reverse.

Thus, the combination of rungs 10 through 12 enable the running of the conveyor motor from maximum speed in the forward or reverse directions down to and including zero RPM.

The encoder also is arranged to enable control of the screw conveyor drive motor in a range from a full positive maximum speed for the screw conveyor drive motor to a full negative maximum speed for the screw conveyor drive motor and in a range from zero toque output to 100 percent torque output for the screw conveyor drive motor. This control is implemented using the source code. A description of the portions of the source code applicable to the speed and torque relationship of the conveyor motor is as follows.

Rung 28

Maximum torque is calculated, real time, for the bowl motor operating in constant torque mode and constant horsepower mode.

Rung 29 & 30

Maximum torque is calculated, real time, for the conveyor drive system (for example, conveyor motor, gearbox, etc) without speed limitations imposed.

Rung 31

Bowl and conveyor torque values are monitored. If either exceeds 100%, the feed pump is shut-down, rung 32. If either exceeds 110%, the entire centrifuge, including feed pump, is shut down.

Thus, the combination of rungs 28 through 31 enable an operating torque from zero to 100% throughout the entire speed range of the conveyor motor.

The above described centrifuge system is computer operated. In this respect, in accordance with a computer program which is included in the compact disc appendix, and incorporated by reference herein, a local general purpose industrial hardened computer 30 monitors the torque of the conveyor motor 21 and bowl drive motor 19. Speed and directional information about the conveyor motor is sensed by encoder 46, and transmitted to conveyor drive 31 as well. First computer 30 also communicates with pump drive 34, operatively arranged to drive pump motor 35 which in turn drives pump 15. A remote (second) general purpose computer 37 is linked to the local computer 30 via line 39 so that troubleshooting or operation of the system can be monitored and controlled from a remote location, if desired. In a preferred embodiment, the two computers are linked by a telephone modem using commercially available PC Anywhere® software, available from Symantec Corporation, 20330 Stevens Creek Blvd., Cupertino, Calif. It should be appreciated, however, that the two computers can be linked over a network (e.g., LAN), or over a global information network such as the Internet (later versions of PC Anywhere are capable of linking computers over the Internet). Also coupled to computer 30 are transducers associated with bearings 27 and 29 via lines 40 and 41, respectively, to thereby monitor the conditions (vibration and temperature) reflected at these bearings, as is also discussed in detail hereafter in relation to the flow charts and the descriptions of the various programs.

Broadly, in accordance with the present invention the mode of operation of the above-described system produces efficient centrifuge operation with concurrent safe operation of the motors that run the centrifuge. Also, in some modes of operation, throughput of the slurry passing through the centrifuge is maximized while maintaining consistency of separation.

The present invention comprises three general levels of security with respect to operation. First, under some user-selected preprogrammed modes, the system automatically adjusts pump speed and flow while preventing the conveyor and bowl motors from operating in an overload condition, that is, above rated torque. Importantly, this is accomplished while holding bowl speed constant and screw conveyor speed constant (and therefor holding their respective motor speeds constant). Second, in the event rated torque is developed by either of the motors, the system in some modes will shut down the pump. Third, in the event either of the centrifuge motors begins to operate at a dangerous level above rated torque, the system in some modes will shut down the entire system, that is, the pump and the centrifuge will shut down. The torque limit for pump shutdown (level 2) and system shutdown (level 3) are predetermined and programmed into the computer of the invention.

With respect to the first level of protection, in this mode, the speed of rotation of the bowl 11 and the speed of rotation of the screw conveyor 12 are preset by the operator at specific values and maintained constant for each specific type of slurry. In this respect, the operator has knowledge of the characteristics of the specific slurry (e.g., drilling mud and trailings) which is received from the well, and he selects the bowl and screw conveyor speeds for this specific slurry for best separation of the trailings (solids). The torque of the conveyor motor and the torque of the bowl motor which are developed at the specific speeds are measured and monitored. Both of these torques are represented and displayed as a percent of rated torque of their respective motors. The torque associated with the motor operating at the highest percentage of rated torque is designated the predominant torque, and it is this torque which is fed into a PID feedback loop to control pump speed and flow. (Each motor has an associated PID feedback loop associated with it.) If the predominant torque varies from the desired percent of rated torque the computer causes the pump motor to vary the flow to the centrifuge 10 to thereby maintain the desired percent of rated torque while maintaining the speed of the bowl and the speed of the screw conveyor constant, albeit at different speeds. By virtue of the foregoing mode of operation the trailings are removed from the slurry in an efficient manner. In this respect, specific types and quantities of trailings are removed without removing more than those specific trailings or less than those specific trailings. In other words, if the speed of the bowl motor was increased, drilling mud of less weight than the specific trailings would be removed from the slurry and discarded with the trailings. If the speed of the bowl was decreased, undesirable trailings would be retained in the slurry and conducted back to the tank, thereby lessening the efficiency of the separation. If the speed of the screw conveyor was increased, more than the specific trailings could be discharged and discarded, thereby possibly losing expensive drilling mud. If the speed of the screw conveyor motor was decreased, excess accumulations of trailings could be experienced on the inside of the bowl, which could results in loading the conveyor motor excessively. Most importantly, the system of the invention prevents either of the motors from overloading while simultaneously operating them at constant speeds, compensating for variable demands of load torque by varying pump flow and speed.

In a preferred embodiment disclosed herein, the operator can preset an upper operating torque limit for the screw conveyor and bowl motors. In operation, the feed pump motor is controlled by the above-mentioned PID feedback loop until such time as the operating torque developed by either the screw conveyor motor or bowl motor exceeds the operator determined preset limit for either motor, at which time the computer control stops operation of the feed pump. At higher levels of developed operating torque (preprogrammed), the bowl and conveyor motors are shut down, and, at even higher predetermined levels, the entire centrifuge system is shut down.

With respect to the oil drilling application of the present invention, reference has been made above to drilling mud and trailings. The drilling mud may be any composition well known in the art which is used in well-drilling operations in the search for oil, and it is used in the conventional manner. The trailings are the substances which are removed from the earth as a result of the drilling operation and are brought to the surface with the drilling mud.

The Software of the Invention

In addition to PC Anywhere described above, there are two general software aspects of the invention. The first software application is written in Rockwell Software's RSLogix™ 5, commercially available from Rockwell Automation, 1201 South Second Street, Milwaukee, Wis. RSLogix software is used to program the PLC-5 family of programmable logic controllers and Softlogix controllers, which, as is well known, are used to control a wide variety of industrial equipment. In the present invention, the PCs control the variable frequency motor drives for both the screw conveyor and bowl motors, as well as the drive for the pump motor.

The second software application is written in RSView™, also available from Rockwell Automation. This software is used to generate the user interface screens shown in FIGS. 18-29.

Source code listings for both of the above-mentioned software applications are included in the attached compact disc appendix, and incorporated herein by reference. It should be apparent to those having ordinary skill in the art that other software applications in other programming languages could accomplish the same result in substantially the same way as the software of the present invention, and these alternatives are intended to be within the spirit and scope of the invention as claimed.

Operation and Use of the Invention

At the outset, it should be appreciated that, while in a preferred embodiment, the screw conveyor motor is a 10 horsepower motor connected to the conveyor through a gearbox, and the bowl motor is a 50 horsepower motor, both of which are driven by variable frequency drives, that other horsepower combinations could be used, depending upon the loads expected. Automatic load sensing and feed pump control enable automated performance optimization. In a preferred embodiment, the bowl assembly can be operated in a range between 1 to 4000 RPM, which can result in an internal centrifugal acceleration of more than 3000 G's, although clearly the invention as claimed is not limited in scope to any particular horsepower and/or speed range. Similarly, to accommodate low levels of agitation and rapid solids removal, in a preferred embodiment, the conveyor is capable of differential speeds in the range of 1 to 100 RPM, although this range is not critical to the invention as claimed.

Each motor is powered by a high performance PWM (pulse width modulated) AC drive with IGBT (insulated gate bipolar transistor) outputs. In turn, each of the motor drives and other peripheral devices are controlled by an environmentally hardened IBM compatible personal computer. The PC and all devices communicate through a high-speed, machine level control network (e.g., DeviceNet).

This PC control enables long-term data storage so that historical data can be logged into historical trends. In addition, with a remote PC, remote monitoring and control of the centrifuge can be accomplished from an adjacent room or from thousands of miles away. Various configurations are possible, regarding security and read/write capability, and a simple telephone line connection to the onboard high-speed modem or Ethernet connection to a Local Area Network (LAN) can provide multiple users "real-time" machine status information. Remote connection capability can also be made over the Internet, and is a powerful tool for troubleshooting and correcting suspected malfunctions without going on-site.

The centrifuge of the present invention can be operated in either a manual or automatic mode. In a manual mode, the operator sets bowl motor speed and conveyor motor speed (by setting the differential speed) and also sets the input pump GPM. The computer monitors torque developed by the screw conveyor motor and bowl motor. If developed torques exceed a first preset limit, the pump motor shuts down. If developed torques exceed a second preset limit, the conveyor and bowl motors shut down. In the automatic mode, the computer takes over control of the pump motor to ensure that the torque developed by the conveyor and/or bowl motors do not exceed predetermined limits. If the developed torques approach these predetermined limits, the computer "backs off" on the pump, by decreasing speed and/or flow to reduce the load presented to the centrifuge motors. In a preferred embodiment and operating mode described in this patent, the operator can preset a desired operating torque (as a percentage of rated torque) for the bowl and conveyor motor (the preset torque value is a target for either the bowl or conveyor motor, whichever develops this percentage of rated torque first controls.) In this auto control mode, the computer controls the pump to achieve the desired operating torque level. As in the previously described modes, however, if the load causes an overload condition for either the bowl or conveyor motor, the computer is programmed to first shut down the pump drive motor, and, at a higher torque overload condition, to shut down the centrifuge motors (conveyor and bowl motors). Thus, the present invention enables multiple modes of operation, some being predefined and some being user configurable. Predefined modes consist of typical settings for Solids Removal and Barite Recovery. If these predefined settings are not sufficient or optimum, custom setups can be saved by the operator and recalled by clicking a single button. Additionally, feed pump control can be automatic or manual. Automatic control, primarily designed for Barite Recovery, maximizes centrifuge throughput by employing a PID (proportional-integral-derivative) loop. This increases pump output to the centrifuge until the operator input torque set point is reached on either the bowl or conveyor drive motors. If properties of the feed slurry change, the PID loop will dynamically adjust pump output to maintain the torque set point (the operator actually sets motor speed, and thereby impliedly sets the torque set points). This enables even less experienced operators to safely and effectively operate and monitor the apparatus.

The PC also continuously runs a diagnostic program which provides the operator with machine critical status information. Real-time trends of main bearing temperature and vibration levels as well as base vibration and enclosure temperature can be viewed on demand. Messages inform the operator when minimum and maximum bowl, conveyor and pump speeds have been reached. In the event alarms or faults do occur, detailed descriptions pinpoint the cause of the malfunction and enable rapid recovery.

Operation of the invention is best understood with reference to the screen captures of FIGS. 18-37. These screen captures illustrate the user interface of the invention. In operation, the operator operates much of the system from a control panel including a monitor and pointing device, such as a mouse. In a preferred embodiment, the system is so easy to use that a keyboard interface is not required. It should be appreciated, however, that other means of communicating with the computer could be used, such as keyboards, voice recognition, and touch-screens, to name but a few.

Figure 18:
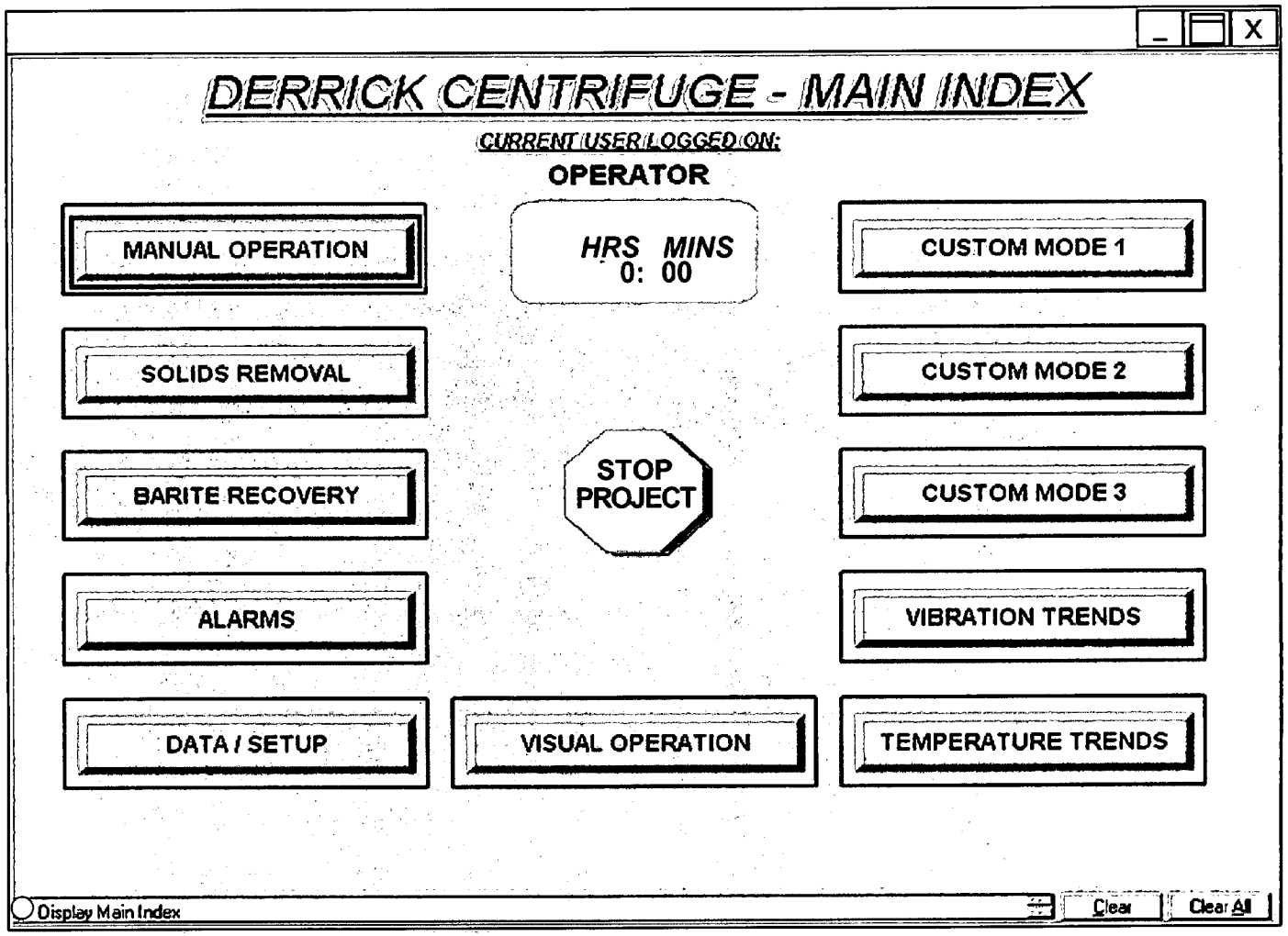

The main system screen is shown in FIG. 18. From this screen the operator has a variety of options and modes of operation, as shown. The operator can select Manual Operation, Solids Removal mode of operation, Barite Recovery mode of operation, Alarms, Data/Setup, one of three different Custom Modes (Custom Mode 1, Custom Mode 2, Custom Mode 3), Vibration Trends, Temperature Trends, or Visual Operation, each of which is described seriatim herebelow.

Figure 19:
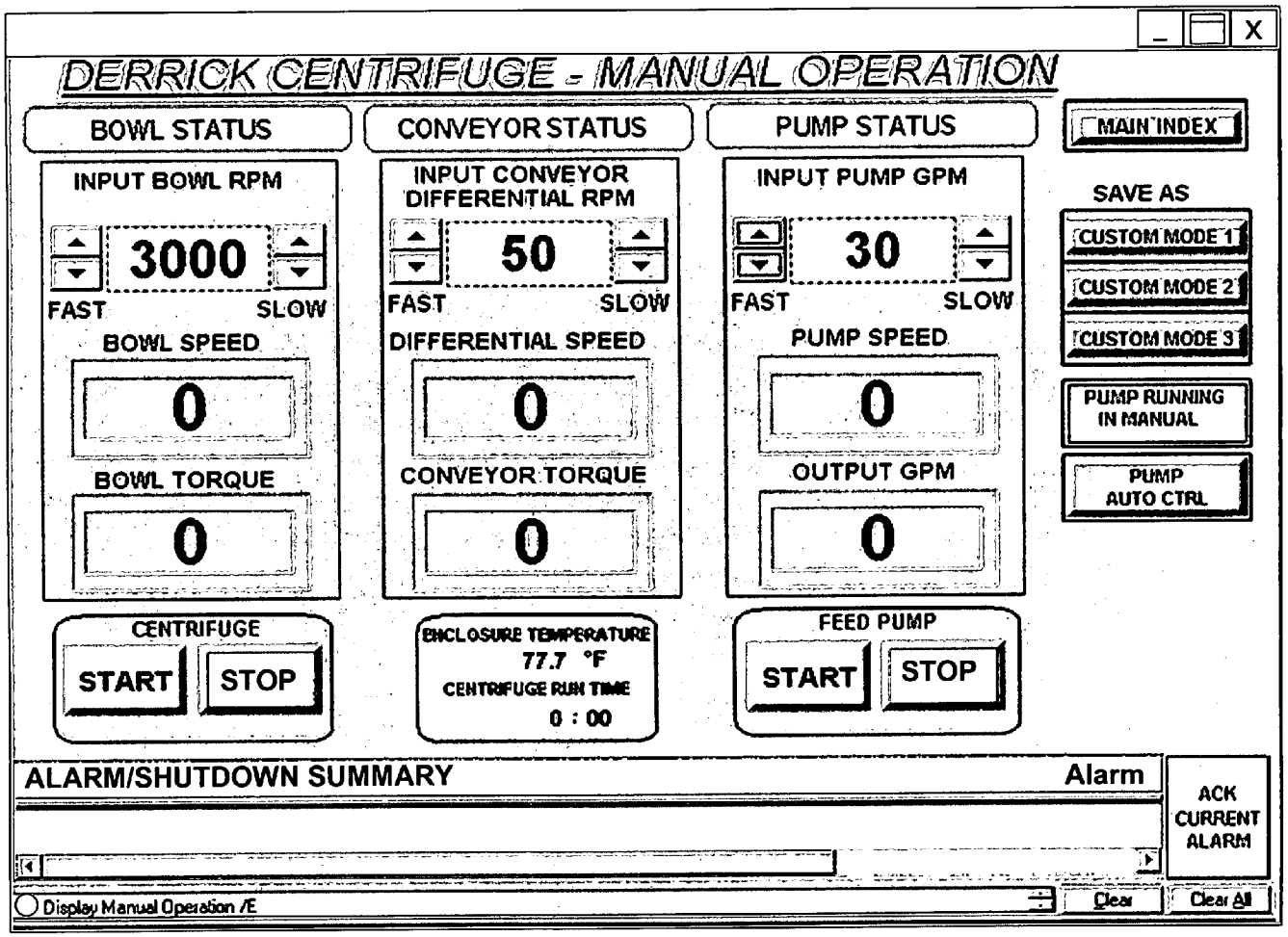

If the operator clicks the MANUAL OPERATION button in the screen shown in FIG. 18, the screen shown in FIG. 19 appears. The screen of FIG. 19 allows an operator to monitor and/or set Bowl Speed, Differential Speed (and therefore Conveyor Speed) and Feed Pump GPM. On this screen, the operator selects and sets (by mouse interaction with the up/down (▲/▼) icons on the screen) desired Input Bowl RPM and Input Conveyor Differential RPM which indirectly sets the screw conveyor speed (the conveyor differential RPM is the difference between the bowl RPM and the screw conveyor RPM). In the example shown, the operator has set the bowl speed at 3000 RPM, and the conveyor differential speed at 50 RPM. In the MANUAL OPERATION mode, the operator can also set the pump flow rate (as shown under the Pump Status column) and, in the example shown in FIG. 19, the operator has set the pump to a flow rate of 30 GPM. Once the desired parameters are set (as indicated as "black on white" numbers in the fields adjacent the up/down icons), the operator can start the centrifuge by clicking on the START button under the word CENTRIFUGE, and can start the feed pump by clicking on the START button under the words FEED PUMP. Once the centrifuge and pump have been started (FIG. 19 shows the centrifuge in STOP mode), the actual measured bowl speed (0 RPM), bowl motor developed torque as a percentage of rated torque (0%), differential speed (0 RPM), screw conveyor motor developed torque as a percentage of rated torque (0%), pump speed, and pump output GPM are displayed. (In FIG. 19, the bowl speed and torque, differential speed and torque, pump speed and pump output GPM are all zero because the operator has not yet started the feed pump). In FIG. 19, these measured parameters are shown as "black on gray" in fields under their respective headings, under the general headings "Bowl Status", "Conveyor Status", and "Pump Status", respectively. This screen also displays enclosure temperature and centrifuge run time. The preset settings from this screen can be saved as Custom Modes for future use by clicking on the appropriate Custom Mode button (1, 2 or 3) under the SAVE AS wording on the upper right of the screen. This screen also provides the operator with an Alarm/Shutdown Summary in the window at the bottom of the screen, where he can view or acknowledge the most recent alarm. Examples of alarm conditions include a centrifuge motor exceeding rated torque, excessive bearing temperature or vibration, excessive enclosure temperature, and a number of other conditions. Finally, this screen includes icons for selecting manual or automatic pump running modes (in FIG. 19, pump running mode is selected as manual as evidenced by the "black on gray" status of this icon). The operator would select automatic operation by clicking on the Pump Auto Ctrl button. As described previously, in the automatic mode, the computer would automatically control the pump to meet preselected or predetermined torque operating conditions.

Figure 20:
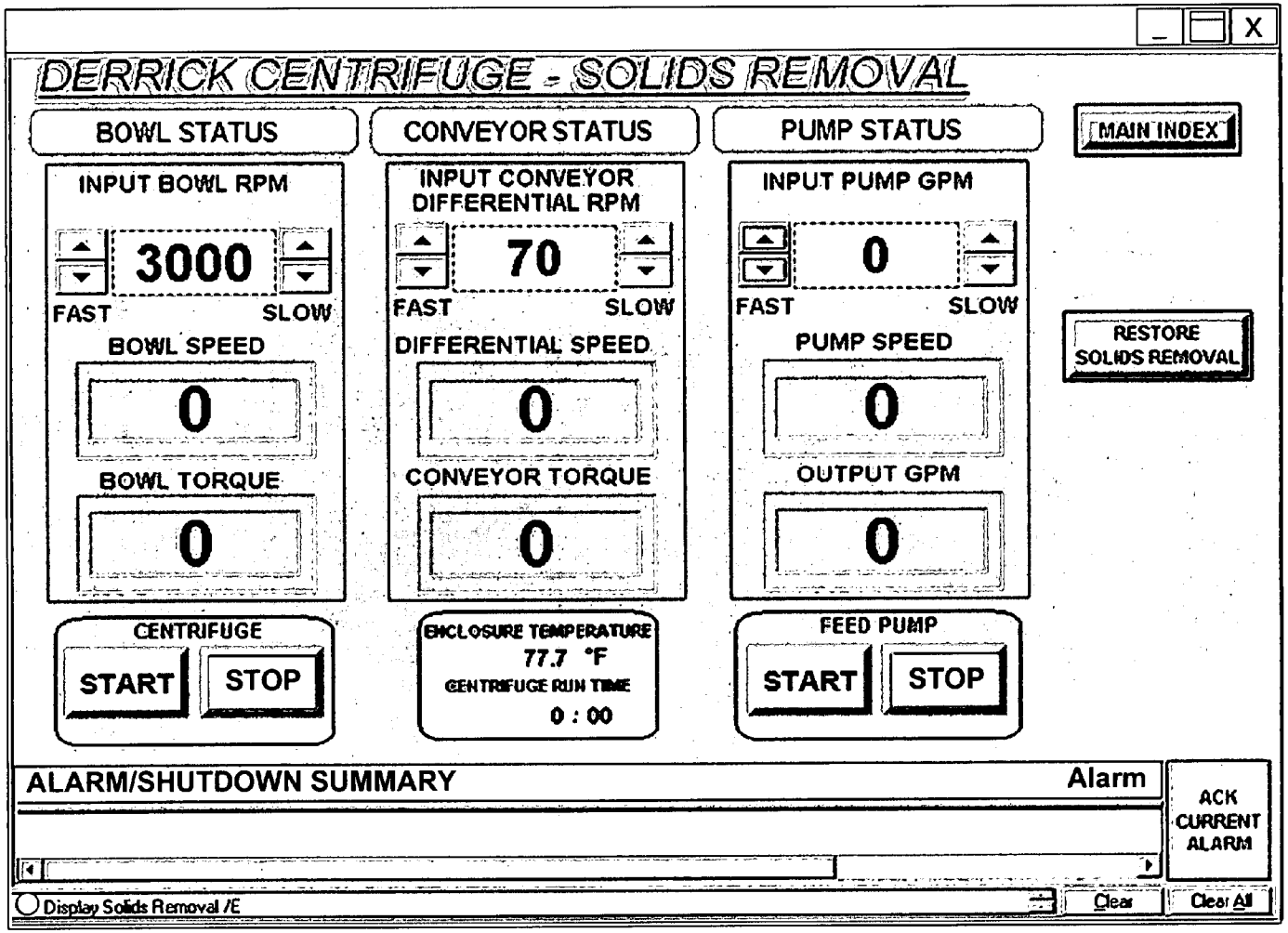
Figure 21:
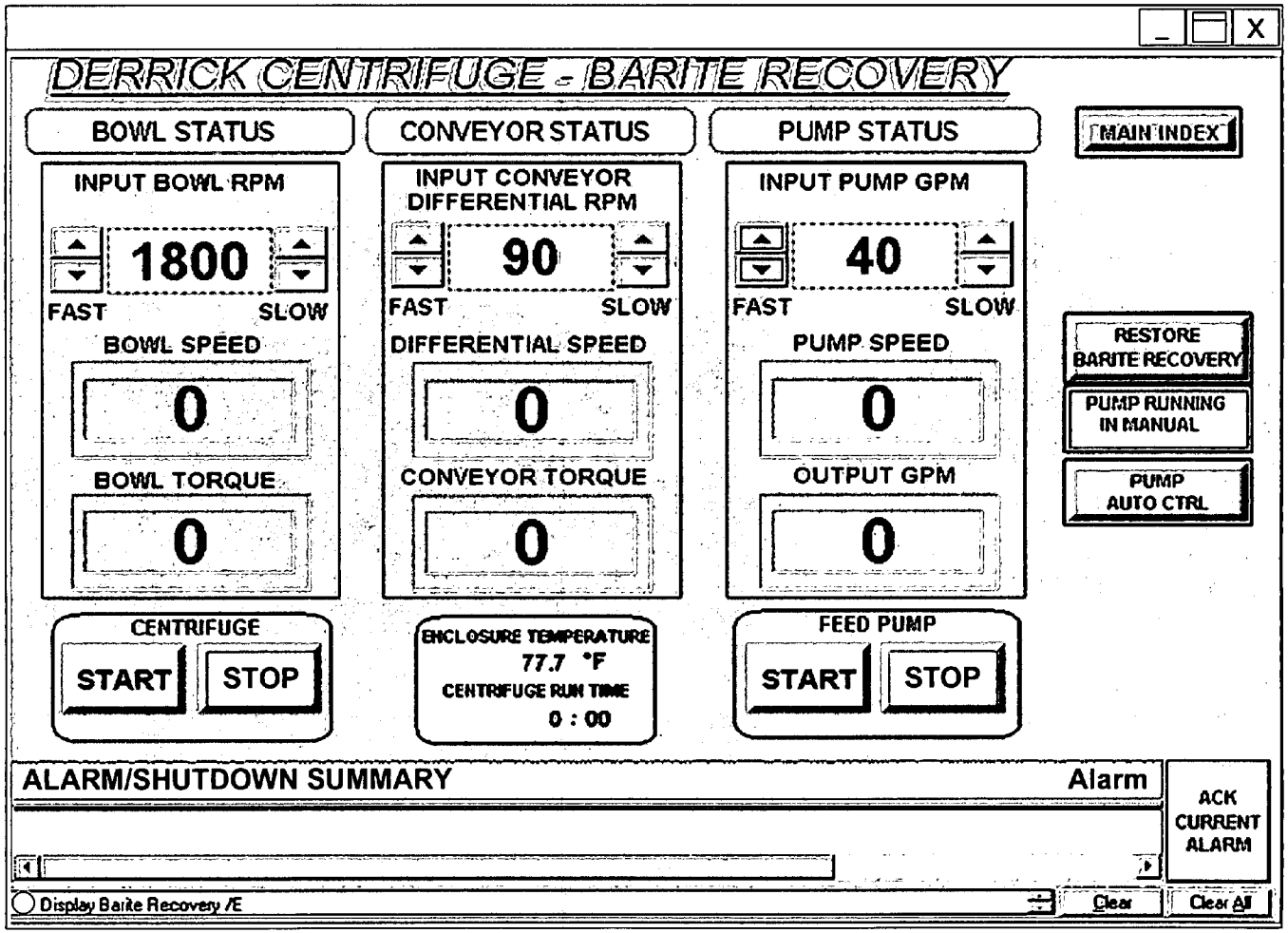

Selection of the SOLIDS REMOVAL button on the screen shown in FIG. 18 launches the screen shown in FIG. 20. This mode includes preset (at the factory) settings for desired bowl speed (e.g., 3000 RPM) and conveyor differential speed (70 RPM) to achieve a desired consistency of separation of the slurry. As the slurry is presented to the motors as a load, each motor (bowl and conveyor) develops the necessary torque to meet the demands of the load at the preset speeds. The operator can change the preset speeds during operation. In FIG. 20, the operator has started the centrifuge, as indicated by the display of bowl RPM and conveyor differential RPM, but has not yet activated the feed pump (by clicking on the START button under the words FEED PUMP). Once he starts the feed pump, the computer will automatically display the speed and flow of the pump. In this and other manual and automatic modes of operation in a preferred embodiment, the computer is programmed to monitor torques developed by the conveyor and bowl motors and continuously (at a sampling rate of approximately 50 ms) compare the developed torque to rated torque. If the developed torque of either motor reaches a first preset level (above rated torque), the computer will shut down the pump. If the developed torque of either motor reaches a second preset level above the first preset level, the computer will shut down the centrifuge (by shutting down the conveyor and bowl motors). Again, in the BARITE RECOVERY mode, the operator has an option to run the system manually or automatically. As can be seen by the "black on gray" status of the PUMP RUNNING IN MANUAL button, the Barite Recovery mode of FIG. 21 is set for manual. However, it should be appreciated that the Barite Recovery mode may be set for the automatic, as indicated by the PUMP AUTO CTRL button shown on the screen. In the automatic mode, the pump speed and flow rate are automatically controlled in response to measured torque from the screw conveyor and bowl motors. It should also be appreciated that, although the auto control mode is described herebelow with respect to a barite recovery program in an oil drilling application, this mode of operation obviously has many other applications.

By way of introduction to the oil drilling application, barite, or heavy spar, is a sulfate of barium, $BaSO_4$, found in nature as tabular crystals or in granular or massive form and has a high specific gravity. Most crude barite requires some upgrading to minimum purity or density. Most barite is ground to a small, uniform size before it is used as a weighting agent in petroleum well drilling mud specification barite. Barite is relatively expensive, and an important objective of a preferred embodiment of the present invention is to recover barite from the slurry in an oil drilling operation for re-use. In the mode shown in FIG. 21, then, the operator has set the bowl speed to 1800 RPM, and the conveyor differential speed to 90 RPM. He has also set the pump GPM to 40. The system, through the aforementioned PID loop and computer control, is adjusting the pump speed (approximately every 50 ms), to achieve the desired pump GPM. In this screen capture, the operator is running the system in the manual mode.

Should the operator select automatic mode (by clicking on the Pump Auto Ctrl button), the system, through a PID feedback loop linked to the motor operating closest to its rated torque (defined as the predominant torque) would control the pump speed and flow. The idea is to control the pump to optimize operation while simultaneously protecting against either conveyor or bowl motors exceeding their rated torque limits. Both the speed and flow of the pump will vary during operation as the system in this mode operates to maintain constant bowl speed (a first speed) and constant conveyor speed (a second speed). In operation, the computer senses and measures the torque developed by the screw conveyor motor and bowl motor. The measured torques are compared against the rated torques of the respective motors and then represented as a percentage of rated torque. Whichever motor is operating at a higher percentage of rated torque is defined as the predominant torque motor. It is this motor's (predominant) torque which controls a PID loop to control pump flow and speed. It is possible during operation that one motor predominates, and, at a later point in the same operation, that another motor predominates. Each motor has its own PID control loop, each of which is operatively arranged to control pump speed and flow when called upon to do so by the computer.

Figure 22:
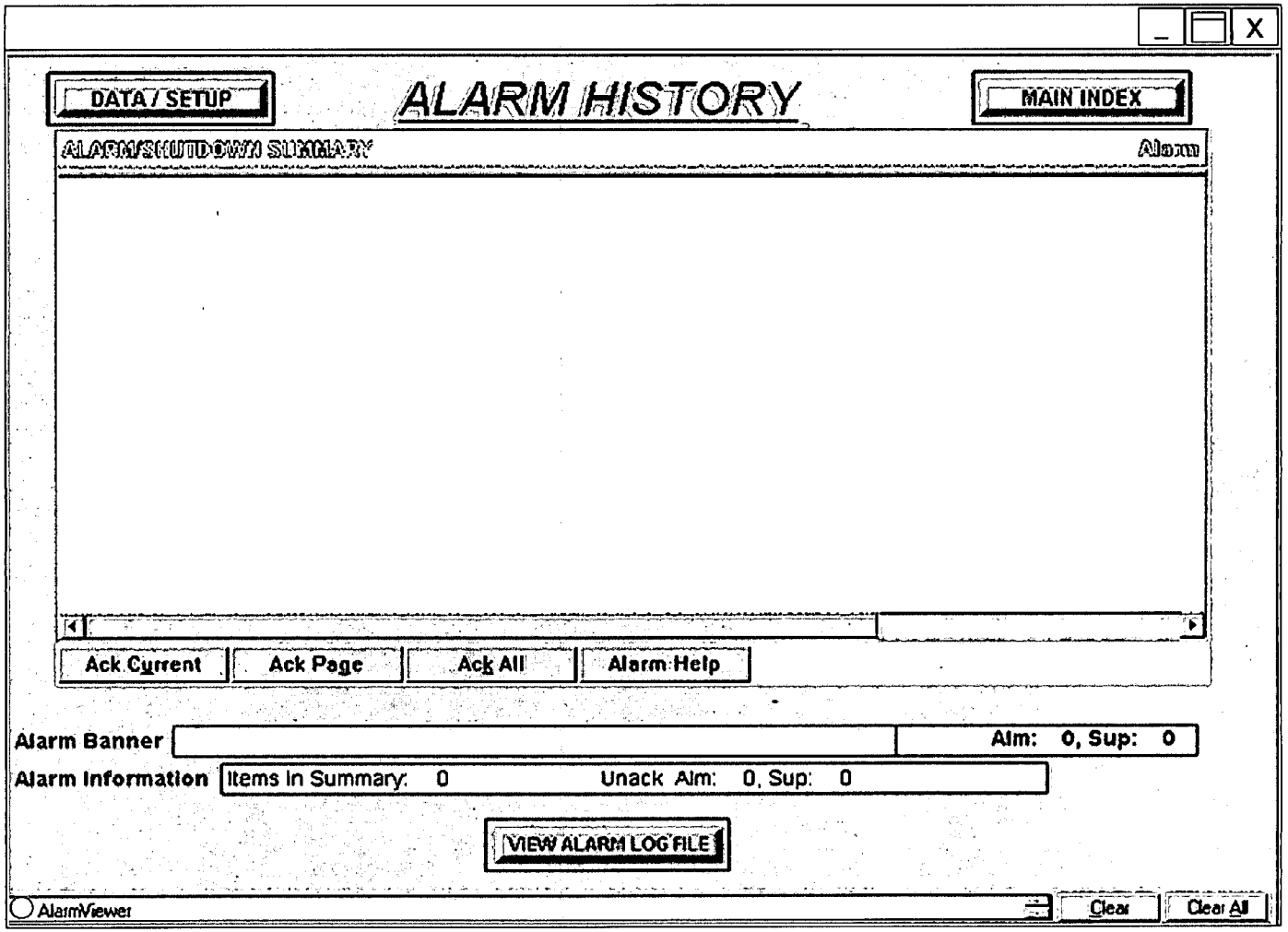

As described previously, the system is preprogrammed to monitor various alarm conditions. For example, FIG. 22 illustrates ALARM HISTORY screen, launched by clicking the ALARMS icon of the screen of FIG. 19. The Alarm History screen provides the announcement of a specific alarm condition, for instance, Maximum Differential Speed Limit Reached is one type of alarm condition that can be displayed. It is also possible to view a log of historical alarm notices, by clicking on the VIEW ALARM LOG FILE button in the lower center section of the screen shown in FIG. 22. Once this button is clicked, an alarm log is launched to display the detailed history of past alarm conditions. The log may include such detailed information as the date and time of the alarm, and a detailed description of the alarm itself.

Figure 23:
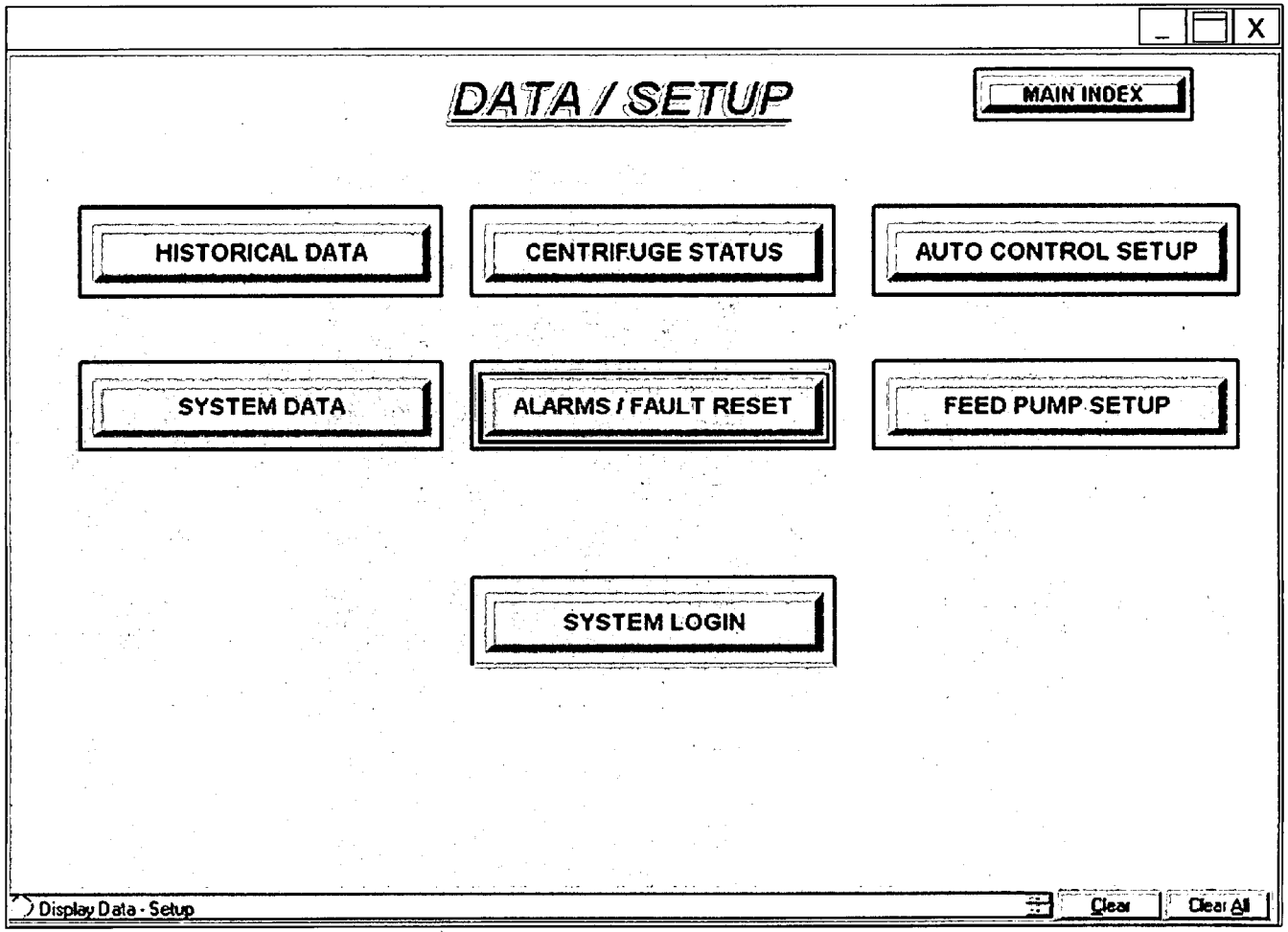
Figure 24:
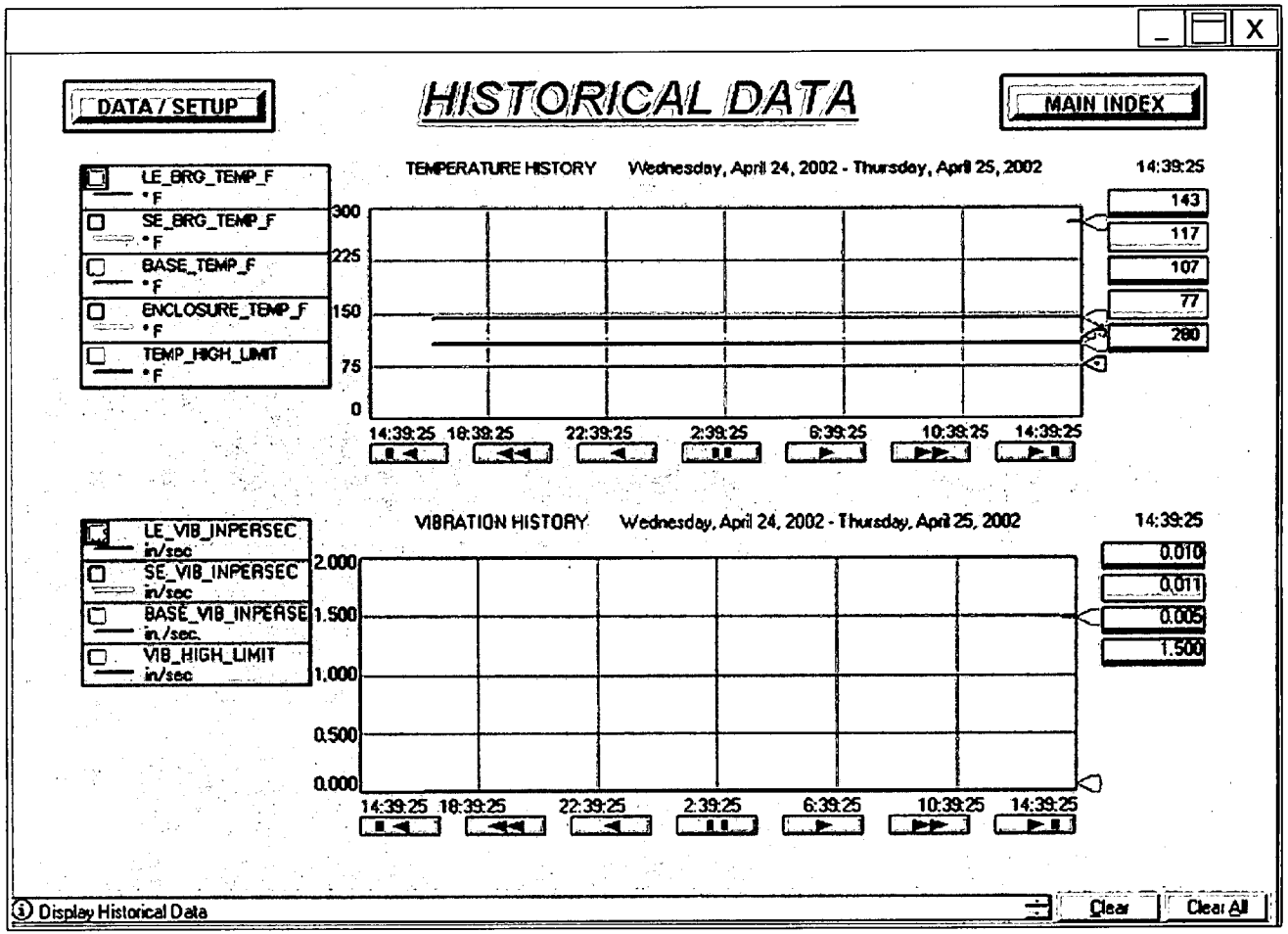
Figure 25:
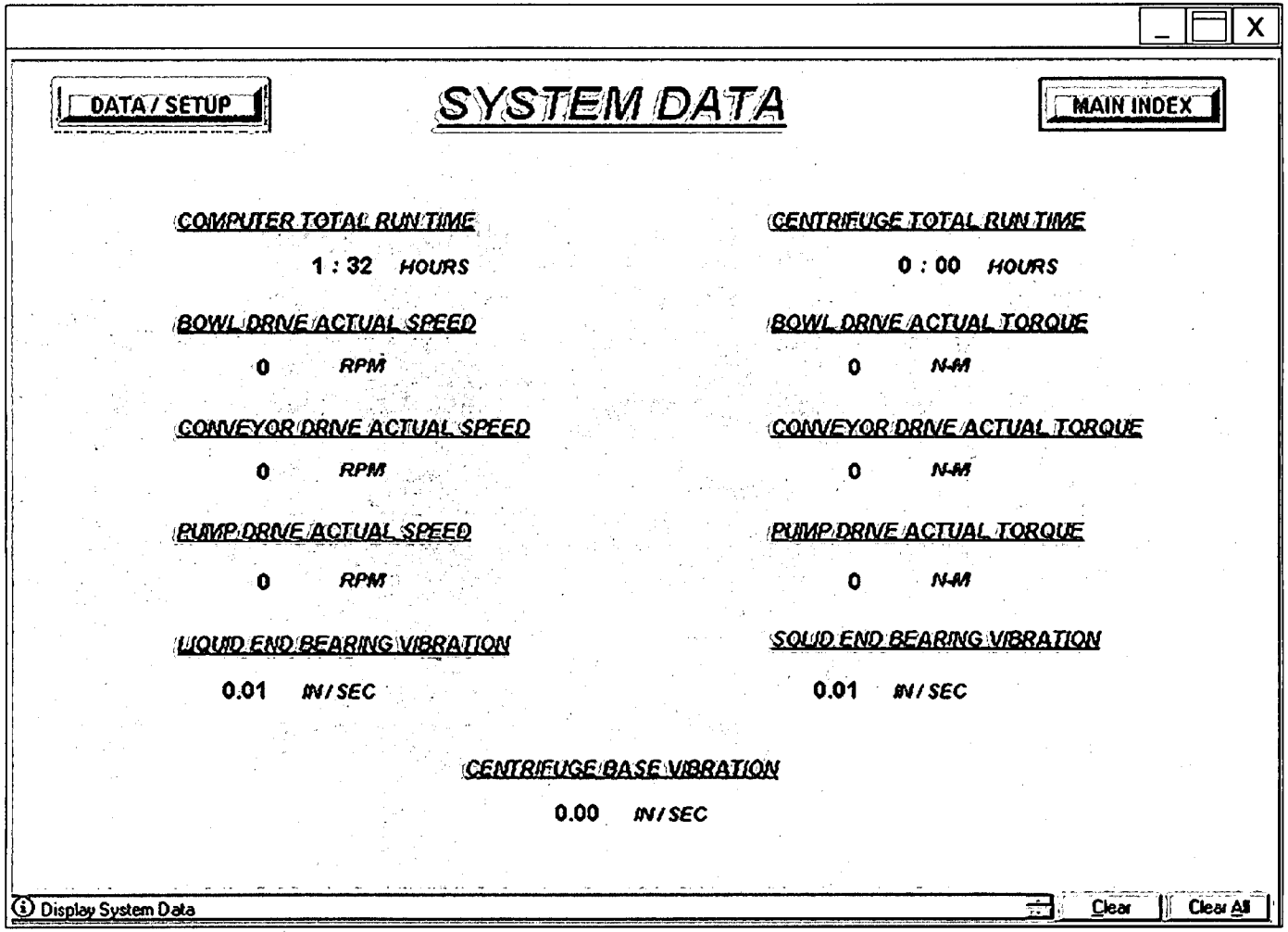

From the main screen shown in FIG. 18, the operator can also access the Data/Setup button, which launches a set of options shown in the screen capture of FIG. 23. Some of these options (System Login) are not particularly germane to the invention. The ALARMS/FAULT reset button is used to reset alarms. The MAIN INDEX button is used to return to the screen shown in FIG. 18. The HISTORICAL DATA button is used to view various historical data, such as that shown in FIG. 24 for bearing temperature and vibration and enclosure temperature. The SYSTEM DATA icon is used to view information pertaining to the operation of the centrifuge and its associated systems as shown in the screen of FIG. 25. As can be seen, the SYSTEM DATA screen allows an operator to obtain and view various operating parameters, such as bowl drive actual speed, conveyor drive actual speed, pump drive actual speed, bowl drive actual torque, conveyor drive actual torque, pump drive actual drive, bearing vibrations and run times. Clicking on either the Data/Setup button or the Main Index button returns the user to the screens shown in FIGS. 23 and 18, respectively.

Figure 26:
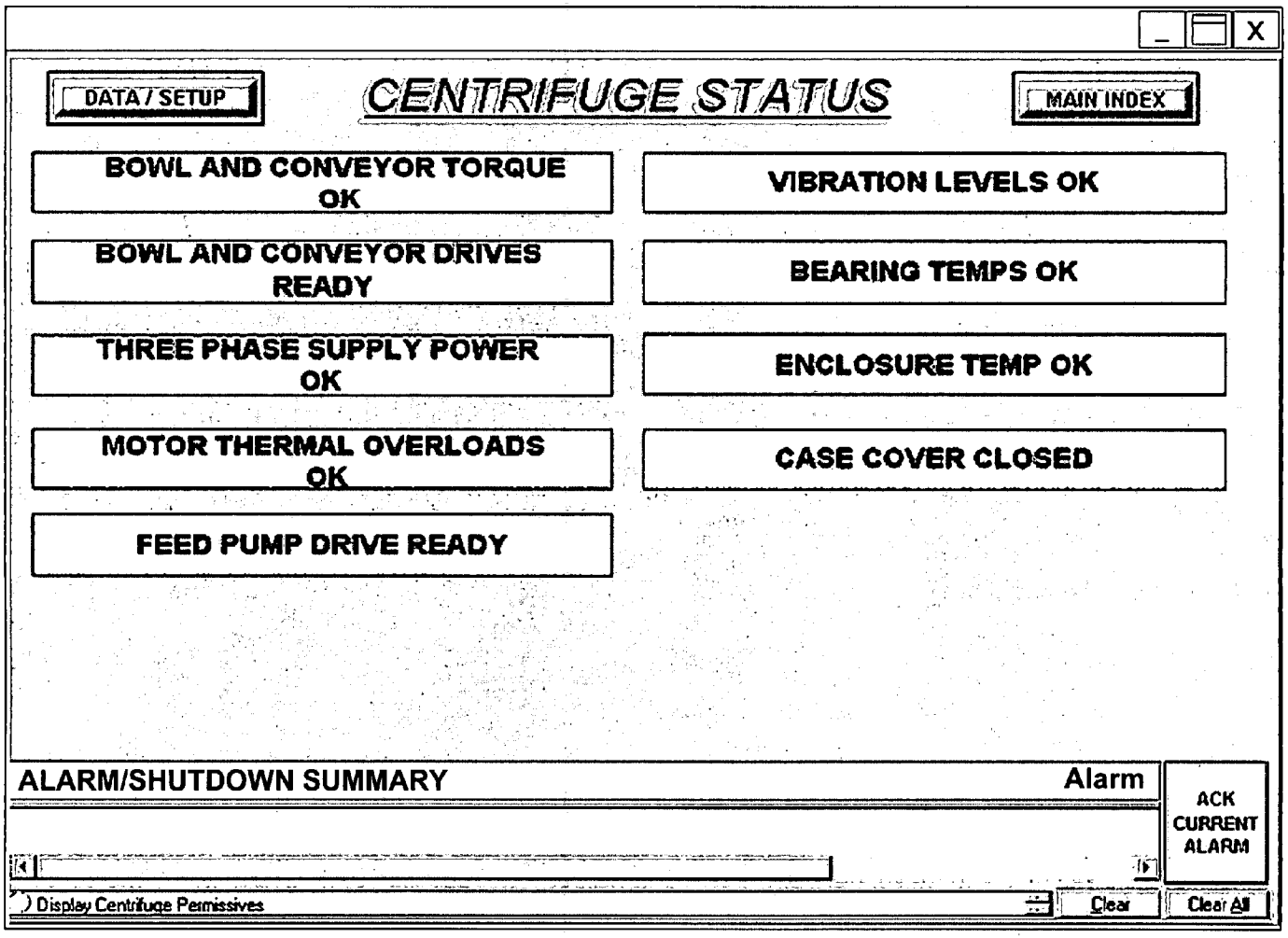

From the screen shown in FIG. 23, by pressing the Centrifuge Status button, an operator can also launch the CENTRIFUGE STATUS screen of FIG. 26, which provides information concerning the operational status of the centrifuge and whether the centrifuge is operating within parameters. As shown in FIG. 26, the CENTRIFUGE STATUS screen provides information concerning bowl and conveyor drives and torque, power supply, motor thermal overloads, the feed pump drive, vibration levels, bearing temperatures, enclosure temperature and whether the case cover is closed.

Figure 27:
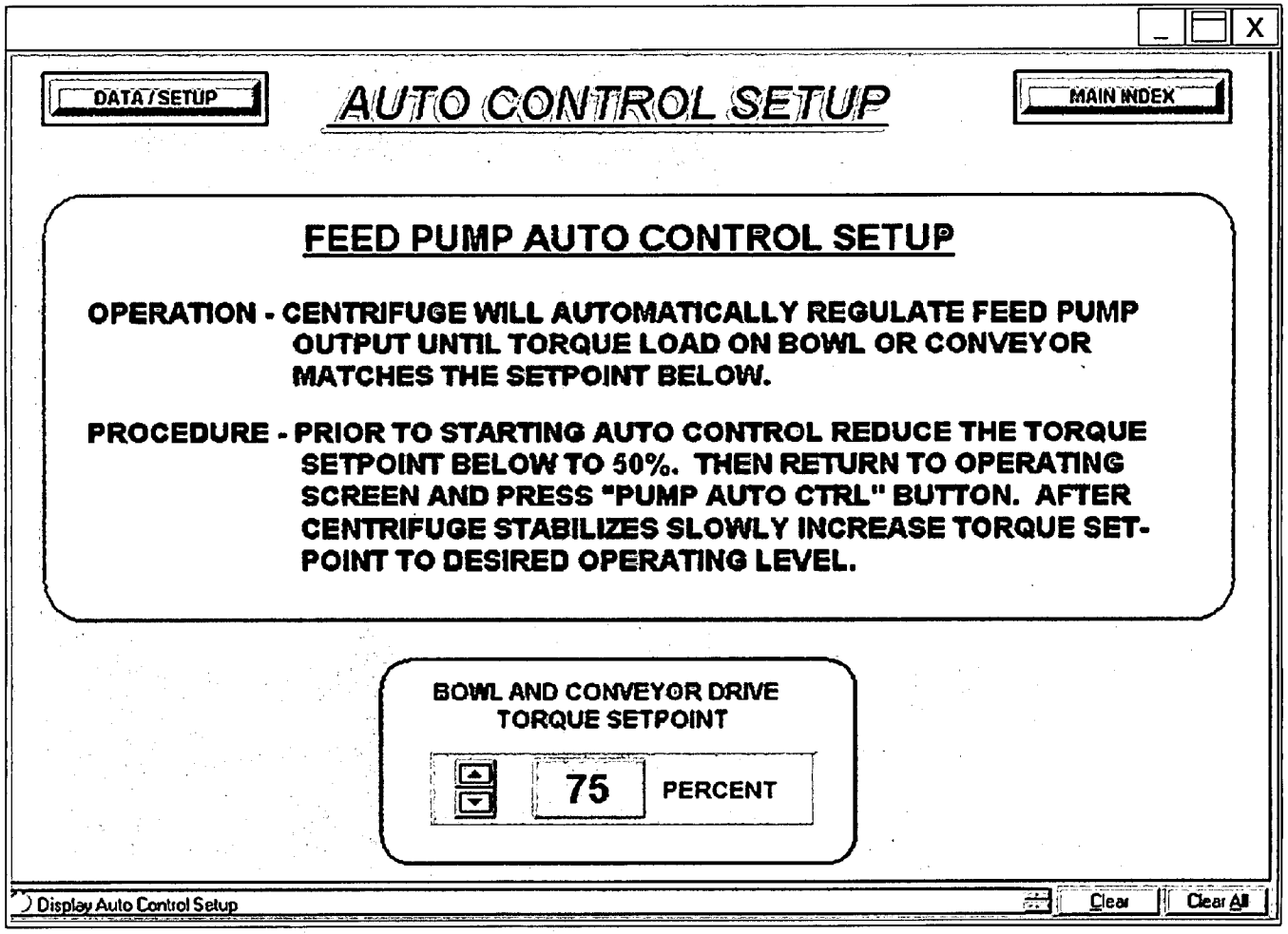

By clicking the Auto Control Setup button of the screen in FIG. 23, the AUTO CONTROL SETUP window of FIG. 27 is opened, which allows an operator to set the centrifuge to automatically operate according to operator defined parameters based on bowl and conveyor drive motor developed torques. As shown in FIG. 27, the operator has preset the desired torque operating level to 75%, but this level can be modified by clicking the up/down (▲/▼) icons. Once the torque level is set, the centrifuge will automatically regulate feed pump output until the developed torque by the conveyor motor OR the conveyor motor reaches the set-point (whichever motor reaches this level first). The computer will maintain this operating condition. It should be appreciated that, in this mode, both the conveyor motor and bowl motors are operating at constant, albeit possible/probably different speeds, while the pump motor speed and flow are regulated. It should also be appreciated that, even in this mode, it is possible that the feed will cause a motor overload, and that at a first overload condition (as determined by developed motor torque) the system will shut down the pump, and at a second higher torque overload condition, the conveyor and bowl motors will shut down. It should be appreciated that these alarm conditions can be determined by measuring developed torque or operating current.

Figure 28:
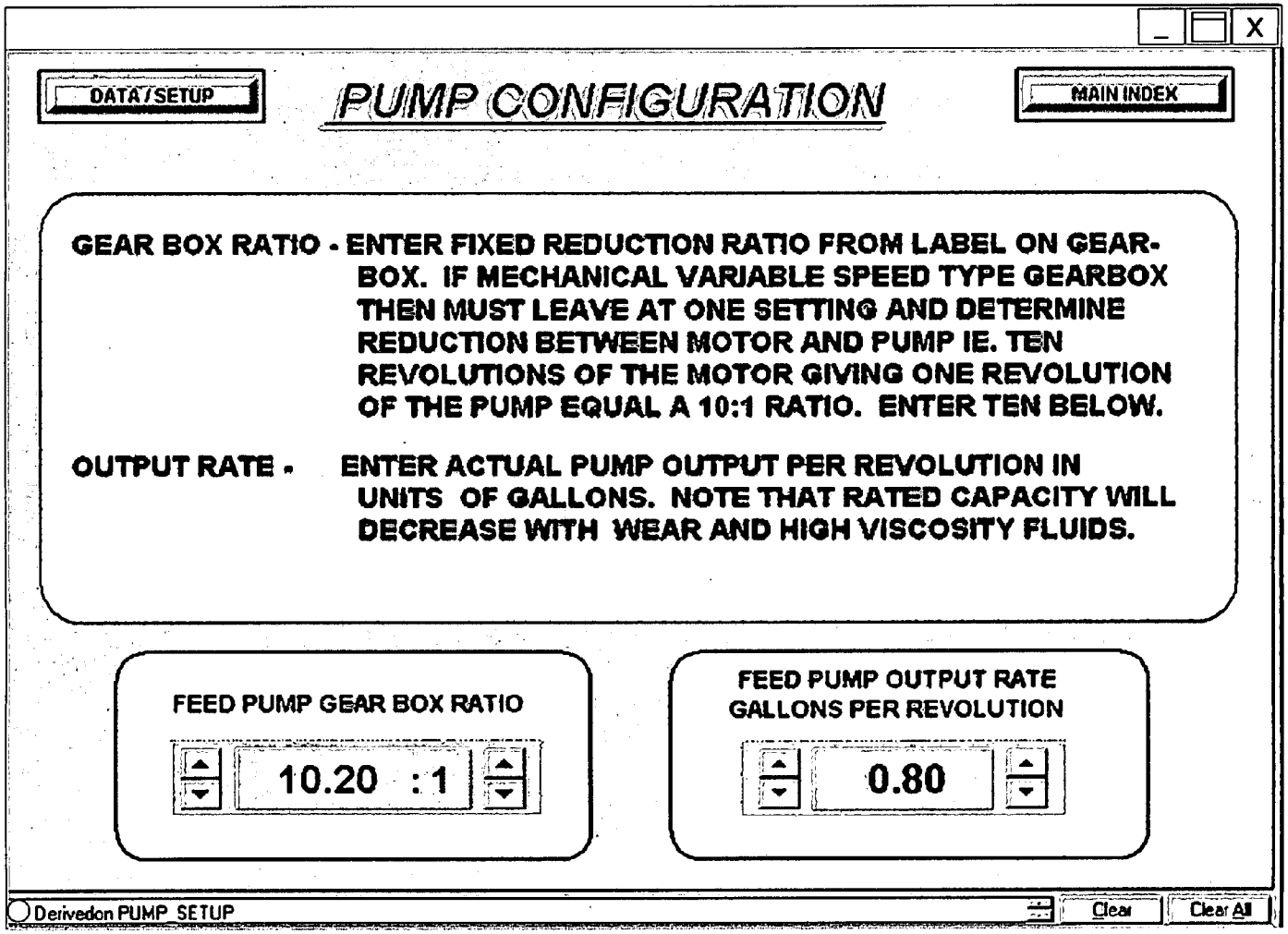

As described previously, one embodiment of the present invention enables operators to use pre-existing feed pumps with the computer controlled centrifuge of the present invention. To do this, the system needs to know certain parameters about the existing feed pump. To launch the feed pump configuration, an operator clicks the Feed Pump Setup button on the screen of FIG. 23 to launch the PUMP CONFIGURATION screen of FIG. 28. As shown in FIG. 28, the operator enters the feed pump gearbox ratio and feed pump output rate (Gal./Rev.), by clicking the appropriate up/down (▲/▼) icons. In the instant case, the feed pump gearbox ratio is set at 10.20:1 and the feed pump output rate is 0.80 Gal./Rev. This embodiment permits a customer of the centrifuge to use an existing positive displacement pump, or positive displacement pump from a manufacturer of his choice rather than ordering the centrifuge system with integral pump. Once the parameters described above are entered, the computer, by transmitting speed reference commands to the variable frequency drive (VFD), and reading actual motor speed back from the VFD, is capable of calculating actual pump flow rates. It accomplishes this by looking at the actual motor speed, at that instant in time, and using the pump gearbox ratio to calculate the speed of the pump rotor. Knowing the speed of the rotor and the fact that its a positive displacement pump and knowing the rated output per revolution, a simple mathematical relationship is used to calculate flow rate in gallons per minute.

Figure 29:
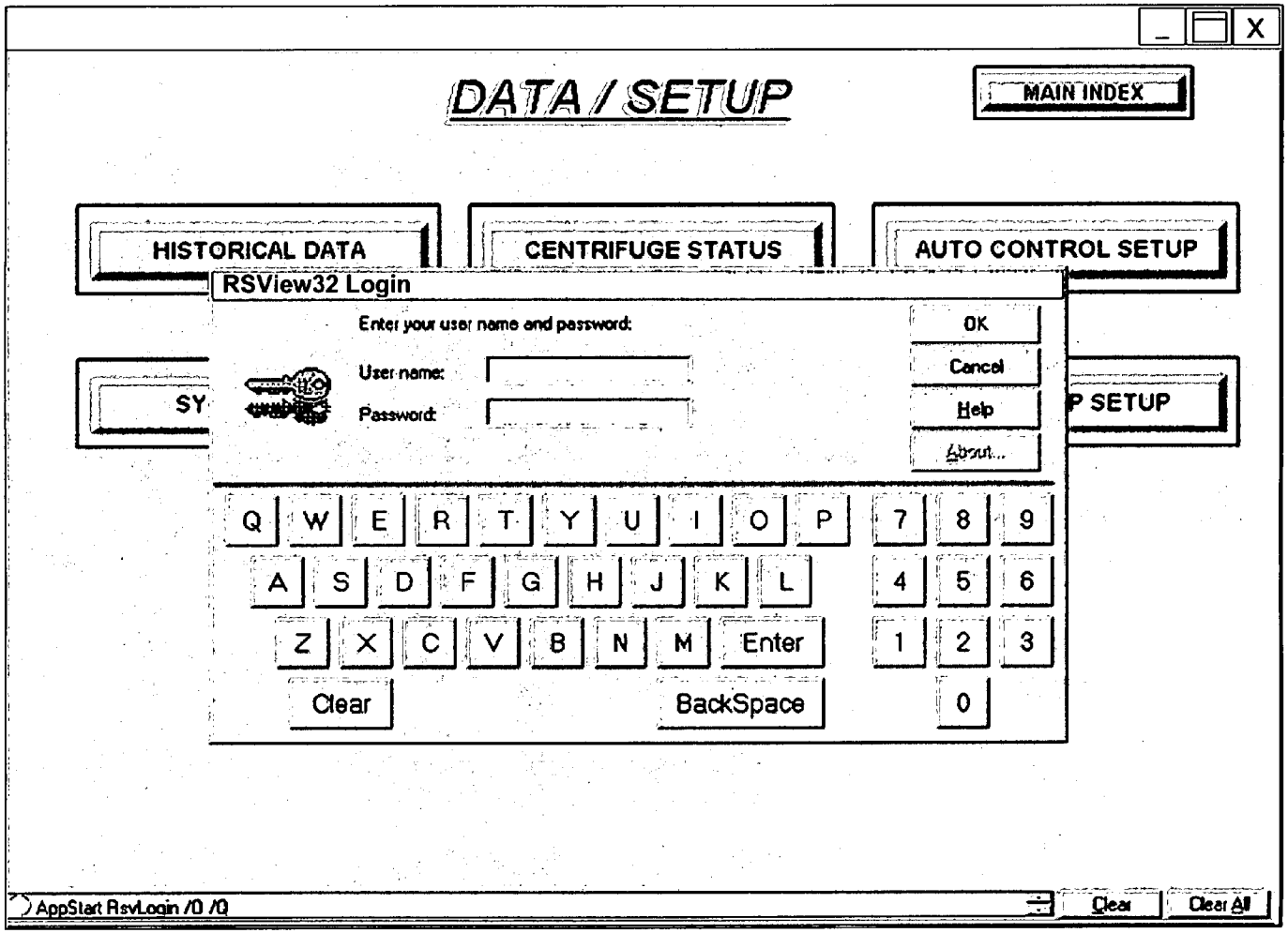

By clicking the System Login button from the screen of FIG. 23, the USER LOGIN window, as shown in the screen in FIG. 29, is launched. The user login window comprises fields for providing a username and password and also comprises an on-screen keyboard/pad that allows the operator to supply the required information without the need of a separate keyboard.

Figure 30:
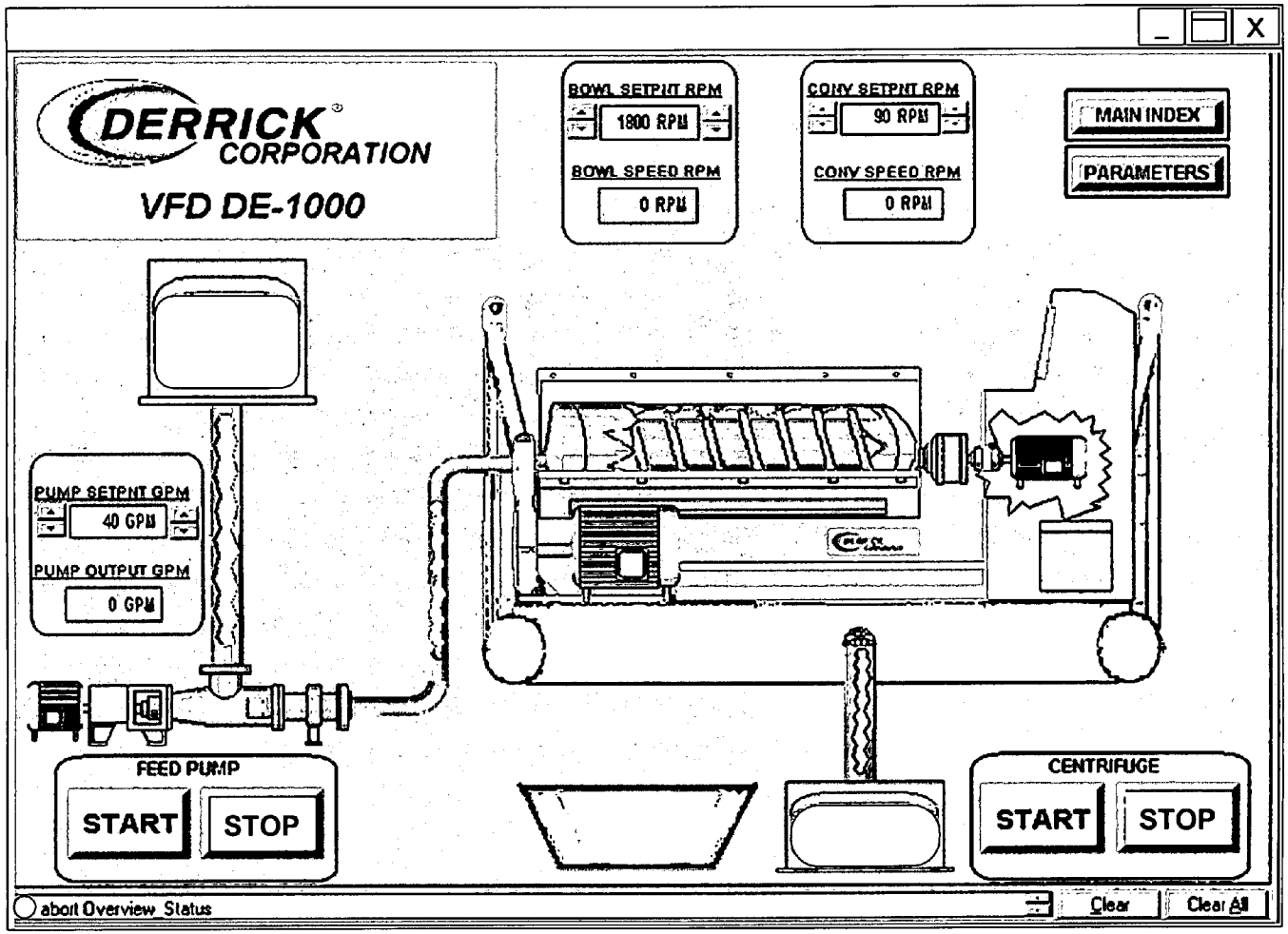
Figure 31:
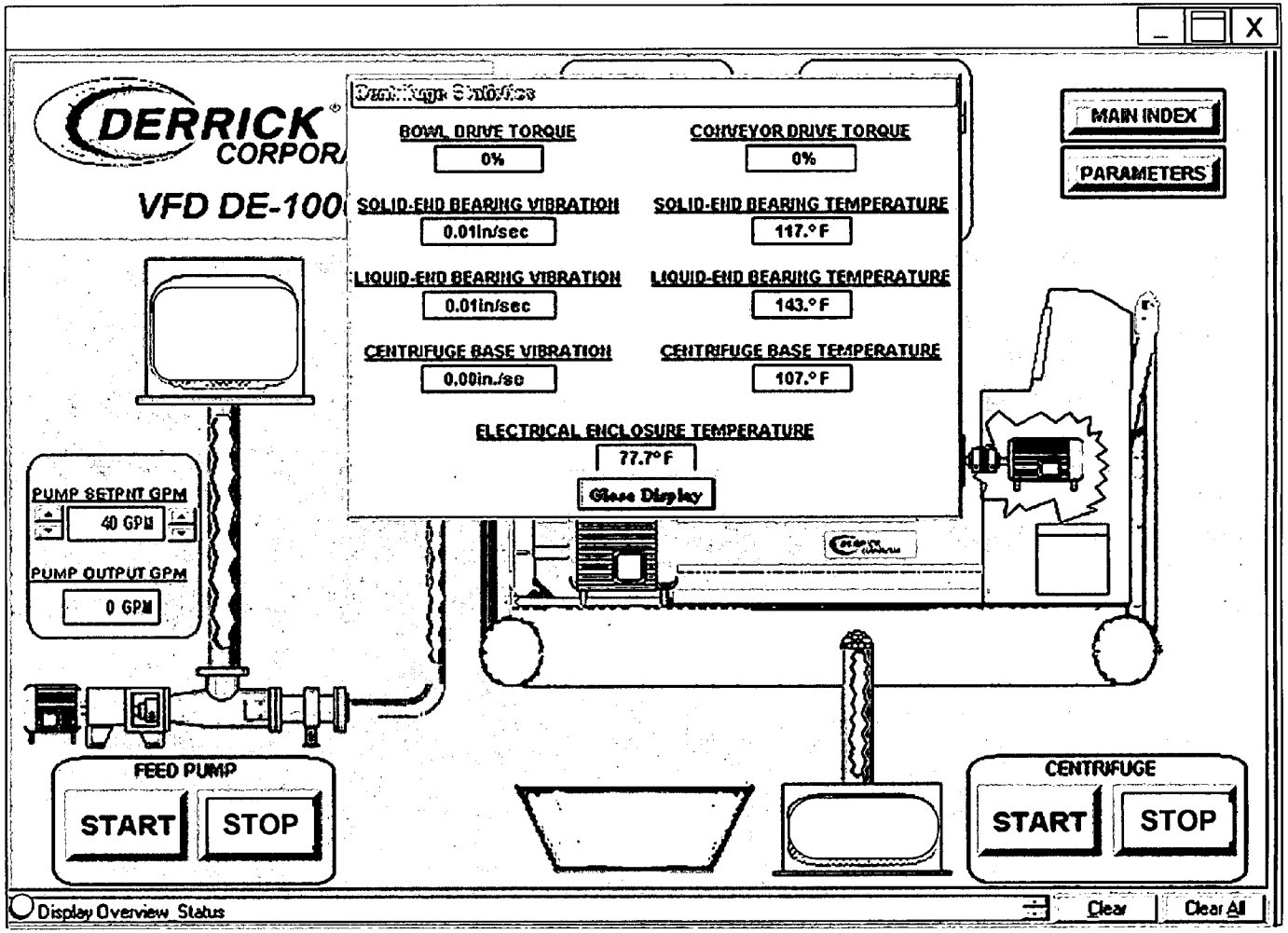

By clicking the Visual Operation button shown in FIG. 18, the screen of FIG. 30 launches. This screen illustrates a dynamic view of the overall system. By clicking on the Parameters button on this screen, the centrifuge statistics appear as shown in FIG. 31.

Figure 32:
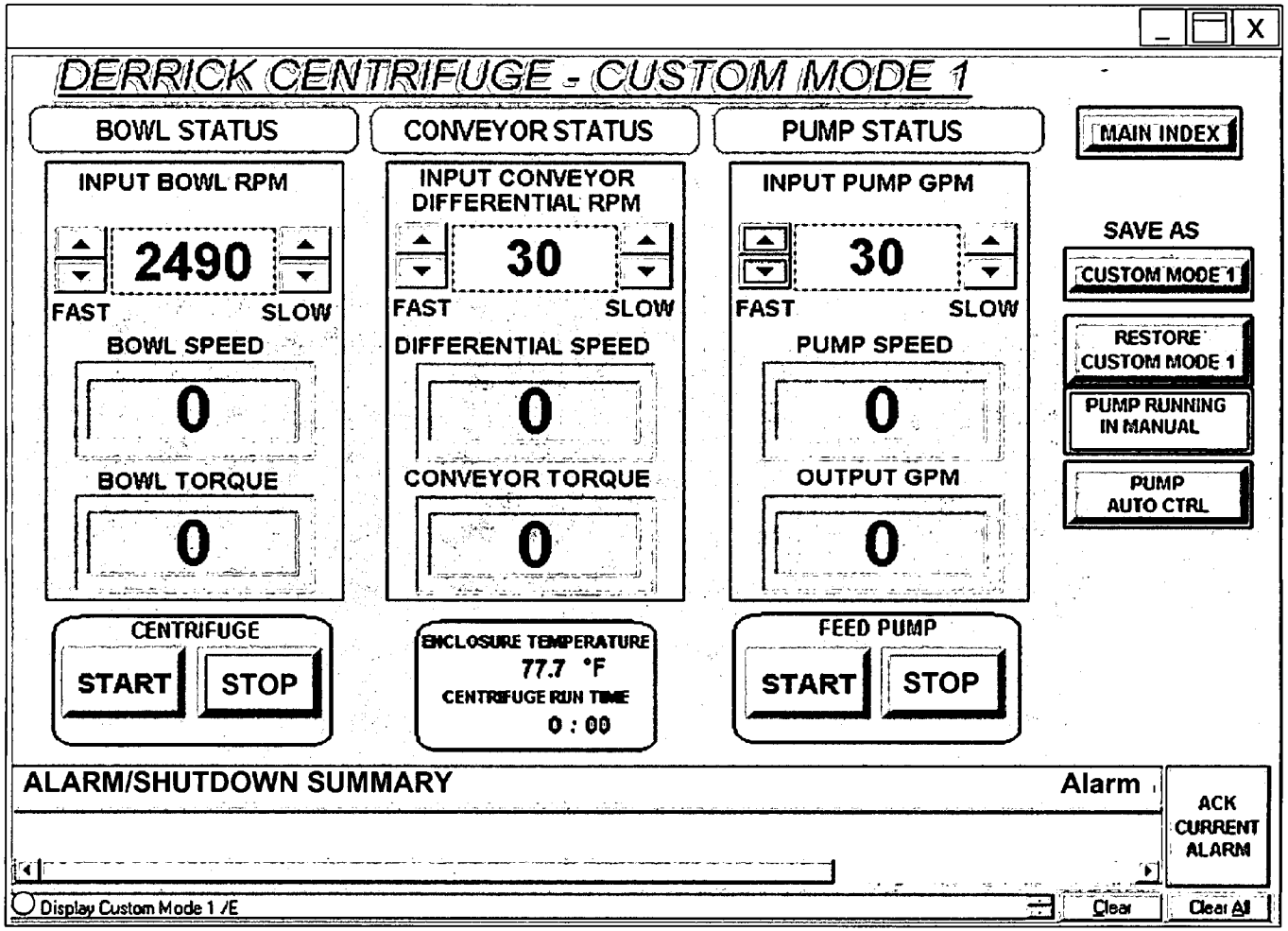
Figure 33:
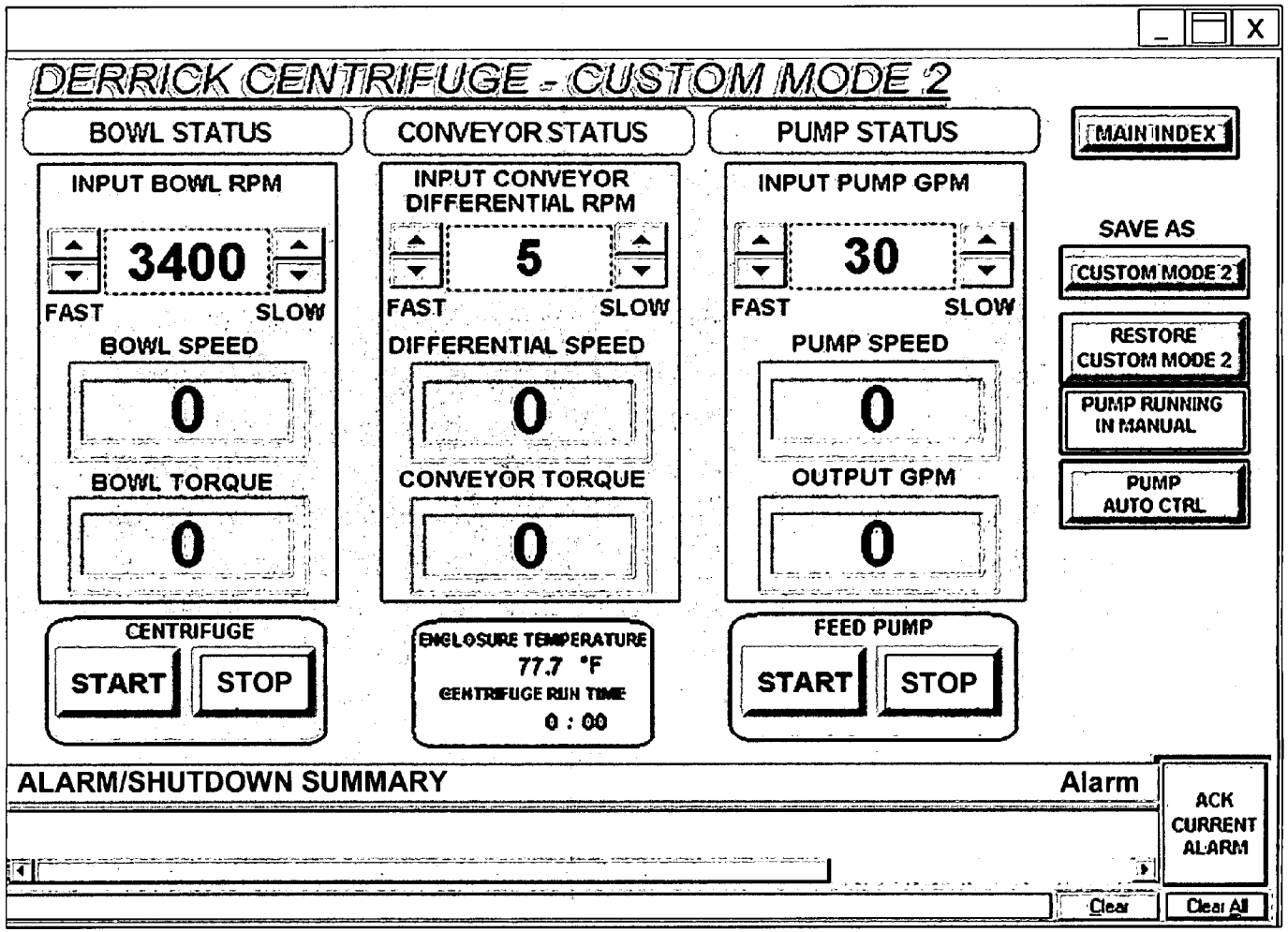
Figure 34:
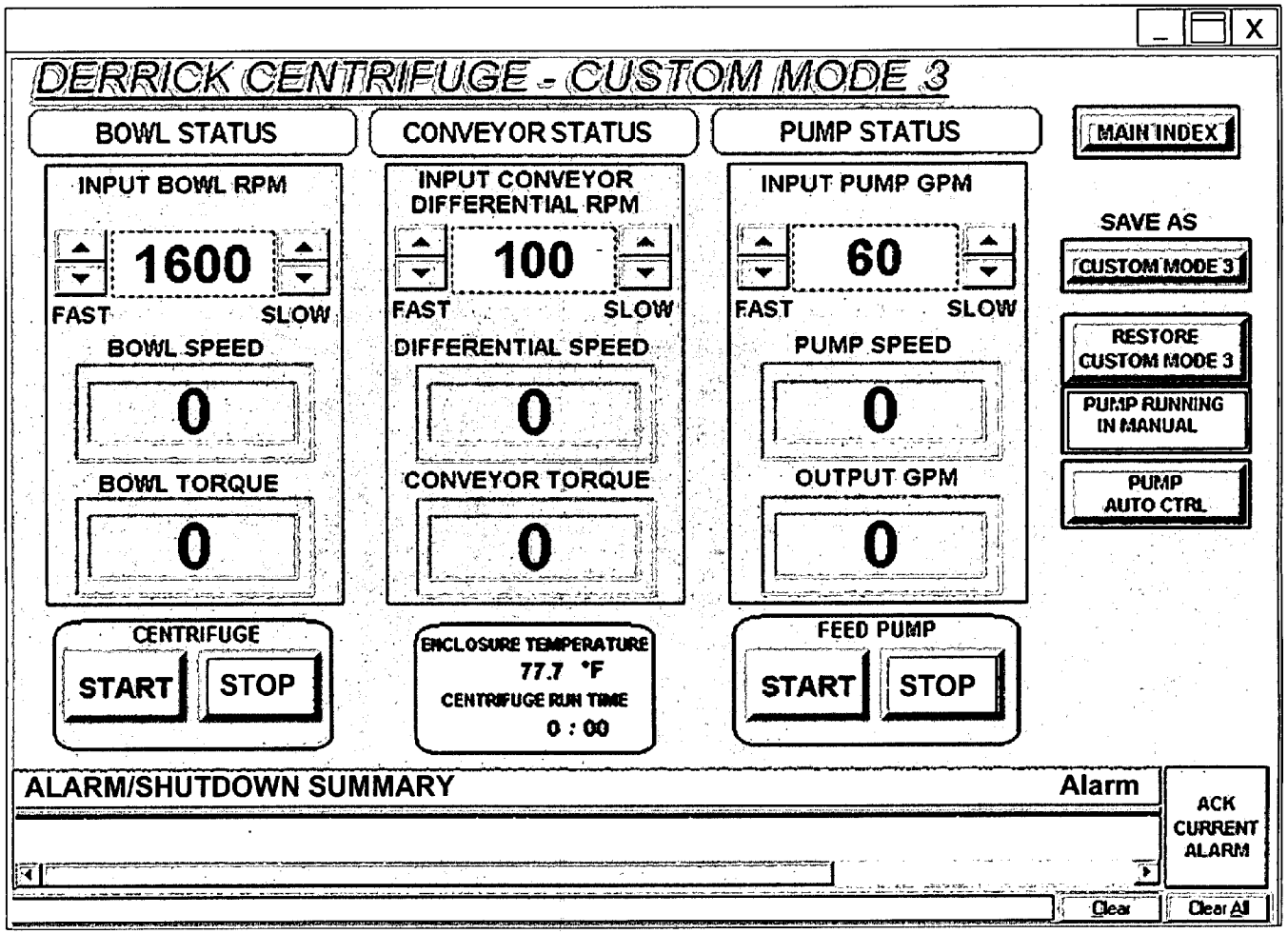
Figure 35:
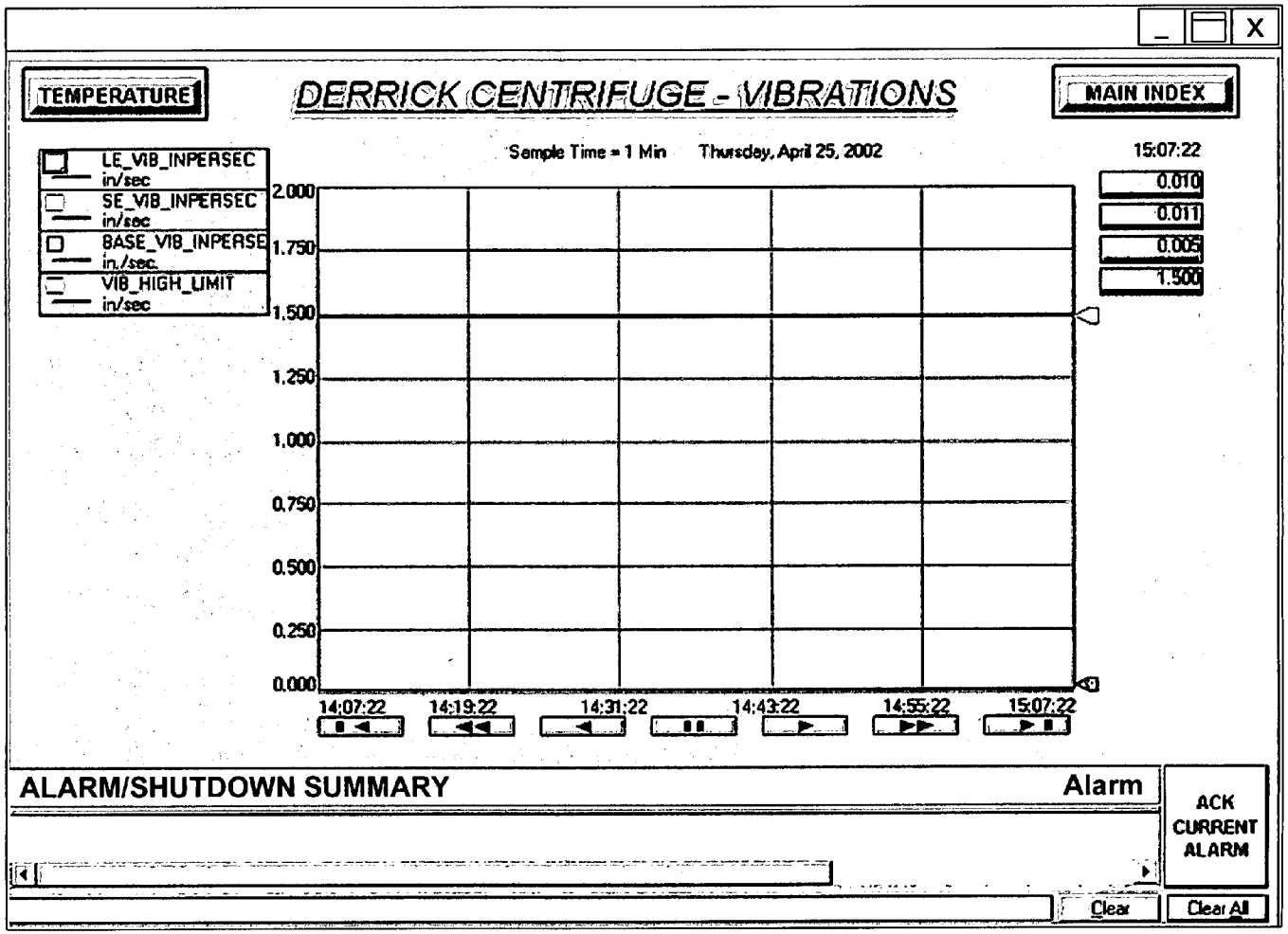
Figure 36:
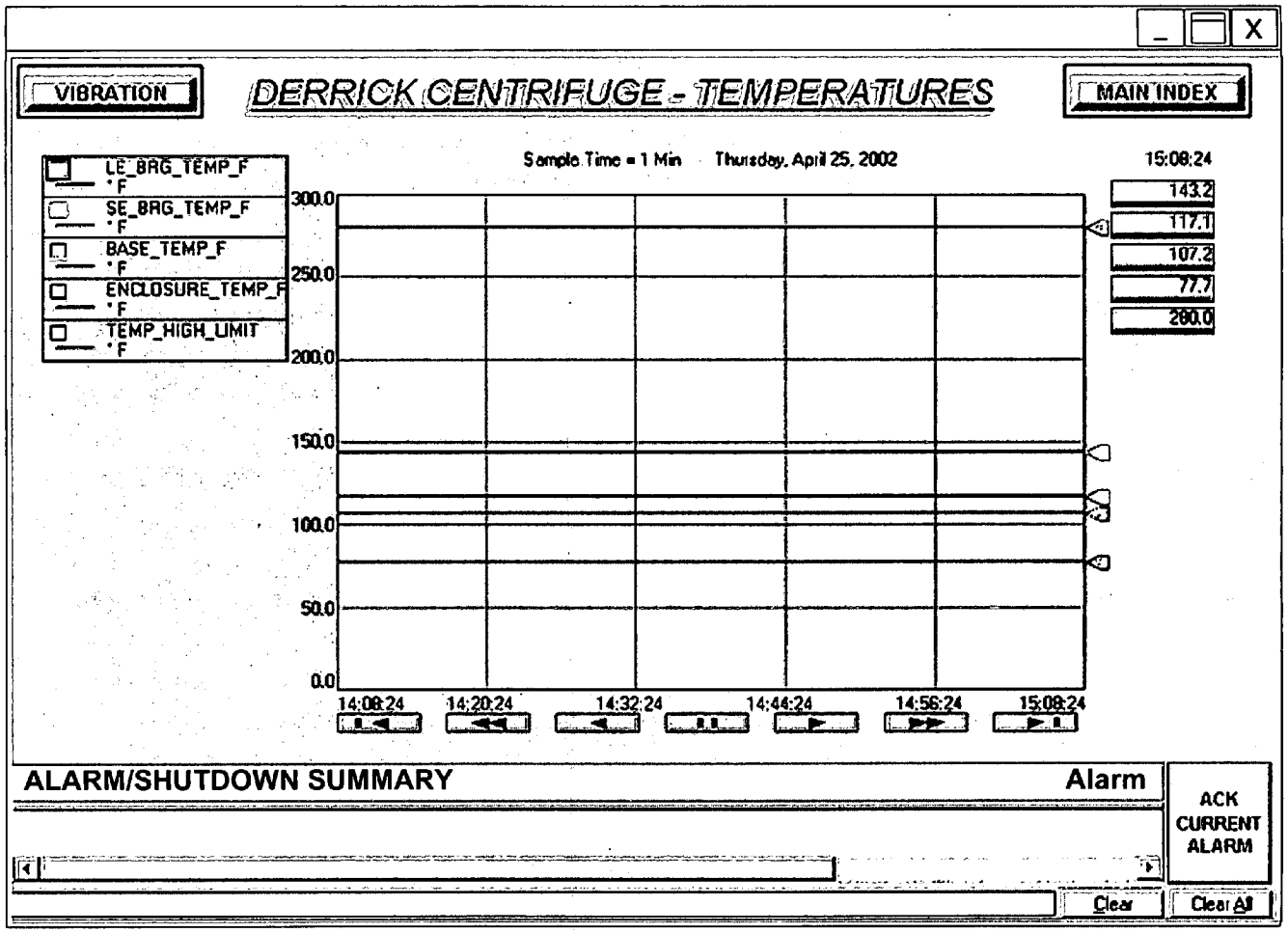
Figure 37:
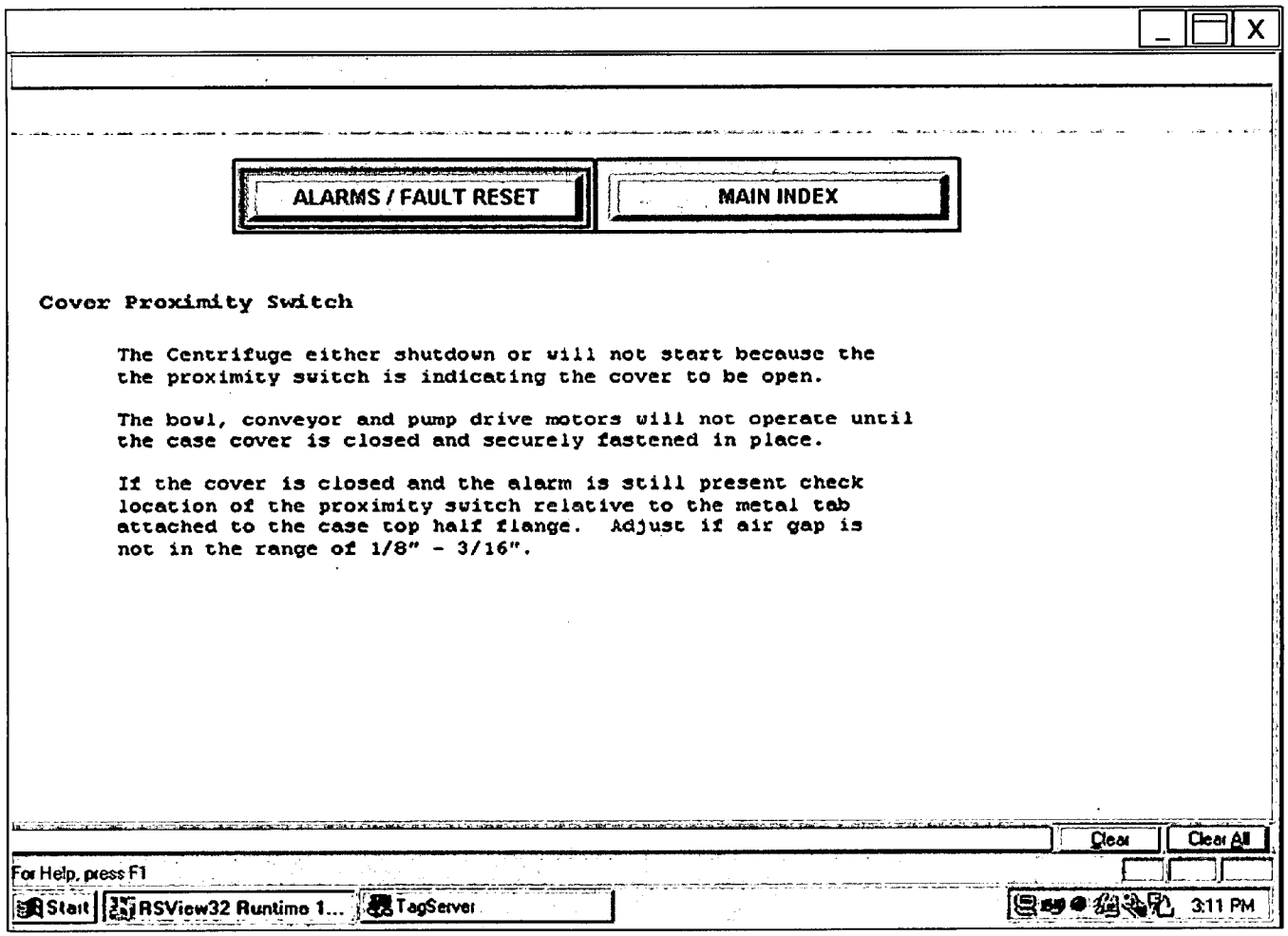

At any time during operation, the operator may save current operating inputs in a CUSTOM MODE file, as described previously and shown with respect to FIG. 18. The operator can then select those pre-saved operating parameters for operation as shown in FIG. 32, where certain preset operating parameters have been stored as CUSTOM MODE 1.

It should be appreciated that the computer software of the invention, included in a program listing appendix on compact disc, operates the computer, and ultimately controls the associated motors that run the centrifuge. The enclosed software is sufficient in and of itself to enable one having ordinary skill in the art to make the invention, and the screen captures illustrated in the drawing figures are sufficient to enable one having ordinary skill in the art to use the invention. The flow charts included in FIGS. 2-17 are self-explanatory and merely explain in more concise terms the logic and flow of the computer program and motor and pump control.

Thus, it should be apparent that the objects of the invention are efficiently obtained, but it should also be understood that modifications, changes and substitutions are intended in the foregoing, some of which have been specifically described, and that these are intended to be within the spirit and scope of the invention as claimed.

What is claimed is:

1. A centrifuge for centrifuging a slurry, comprising:

a bowl driven by a bowl drive motor;

a screw conveyor driven by a screw conveyor drive motor;

a pump driven by a pump motor;

a bowl variable frequency drive unit (VFD) operatively arranged to drive said bowl drive motor;

a conveyor VFD operatively arranged to drive said screw conveyor drive motor;

a pump drive unit operatively arranged to drive said pump drive motor; and, a general-purpose computer (GC) arranged to interactively control said bowl VFD and said conveyor VFD, wherein said GC is configured to maintain a constant differential speed between said bowl and said screw conveyor during acceleration and deceleration of said bowl by calculating, in an iterative process, an instantaneous conveyor motor speed and direction and supplying a speed reference and direction command to said conveyor VFD responsive to said instantaneous bowl speed and desired conveyor speed.

2. A centrifuge for centrifuging a slurry, comprising:

a bowl driven by a bowl drive motor;

a screw conveyor driven by a screw conveyor drive motor;

a pump driven by a pump motor;

a bowl variable frequency drive unit (VFD) operatively arranged to drive said bowl drive motor;

a conveyor VFD operatively arranged to drive said screw conveyor drive motor in a closed loop vector mode;

a pump VFD operatively arranged to drive said pump drive motor;

an encoder operatively arranged to electronically feed information regarding said conveyor drive motor speed and direction to said conveyor VFD; and, a general-purpose computer (GC) interfaced with said conveyor VFD and specially programmed to operate said conveyor VFD in a closed-loop vector mode, wherein said conveyor VFD electronically feeds said information regarding said conveyor drive motor speed and direction to said GC and, in response, said GC controls said conveyor VFD relative to the bowl VFD in response to desired operational parameters.

3. The centrifuge as recited in claim 2, wherein said screw conveyor drive motor has a first maximum rated speed and operates in a forward direction, said first maximum rated speed being the upper limit of the motor constant torque speed range; and, wherein said GC is programmed to operate said conveyor VFD to limit said screw conveyor drive motor to a predefined maximum torque, in said forward direction, from zero revolutions per minute up to said first maximum rated speed.

4. The centrifuge as recited in claim 3, wherein said screw conveyor drive motor has a second maximum rated speed and operates in a forward direction, said second maximum speed being the upper limit of the motor constant horsepower range; and, wherein said GC is programmed to operate said conveyor VFD to limit said screw conveyor drive motor to a maximum torque in said forward direction, from said first maximum rated speed up to said second maximum rated speed, said maximum torque being variable and dependent upon a speed of said screw conveyor drive motor.

5. The centrifuge as recited in claim 2, wherein said GC is programmed to control said bowl VFD to drive said bowl drive motor at a first constant speed and to control said screw conveyor VFD to drive said screw conveyor at a second constant speed.

6. The centrifuge as recited in claim 2, wherein said GC is programmed to take control of said pump drive unit to variably control flow of said slurry through said centrifuge so as to drive one of said bowl drive motor or said screw conveyor motor, whichever is operating at a higher percentage of its rated capacity, at a pre-set operating torque.

7. The centrifuge as recited in claim 2, wherein said screw conveyor drive motor has a maximum rated speed and operates in a reverse direction, said maximum rated speed being the upper limit of the motor constant torque speed range; and, wherein said GC is programmed to operate said conveyor VFD to limit said screw conveyor drive motor to a predefined maximum torque, in said reverse direction, from zero revolutions per minute up to said maximum rated speed.

8. The centrifuge as recited in claim 7, wherein said screw conveyor drive motor has a fourth maximum rated speed and operates in a reverse direction, said fourth maximum rated speed being the upper limit of the motor constant horsepower range; and, wherein said GC is programmed to operate said conveyor VFD to limit said screw conveyor drive motor to a maximum torque from said third maximum rated speed up to said fourth maximum rated speed, said maximum torque being variable and dependent upon a speed of said screw conveyor drive motor.

9. A centrifuge for centrifuging a slurry, comprising:

a bowl;

a pump;

a screw conveyor comprising a screw conveyor drive motor and a gear box;

a screw conveyor variable frequency drive unit (VFD) operatively arranged to drive said screw conveyor drive motor and to provide a first value corresponding to a first instantaneous torque for said screw conveyor drive motor; and, a general-purpose computer (GC) specially programmed to:

select a second value, according to a speed of said screw conveyor motor, corresponding to an operational parameter of said screw conveyor, said second value comprising a torque;

compare said first value with said second value; and, in response to said comparison, control said pump so that said screw conveyor operates at or below said second value.

10. The centrifuge as recited in claim 9 wherein said gearbox has a maximum allowable torque rating and said second value is said maximum allowable torque rating for said gearbox.

11. The centrifuge as recited in claim 9 wherein said screw conveyor drive motor has a maximum allowable torque rating and said second value is said maximum allowable torque rating for said screw conveyor drive motor.

12. A centrifuge for centrifuging a slurry, comprising:

a bowl;

a pump;

a screw conveyor comprising a screw conveyor drive motor and a gear box;

a screw conveyor variable frequency drive unit (VFD) operatively arranged to drive said screw conveyor drive motor and to provide a first value corresponding to a first instantaneous torque for said screw conveyor drive motor; and, a general-purpose computer (GC) specially programmed to:

select a second value, according to a speed of said screw conveyor motor, corresponding to an operational parameter of said screw conveyor, said second value comprising a torque;

compare said first value with said second value; and, in response to said comparison, control said pump so that said screw conveyor operates at or below said second value, wherein said pump is arranged to operate to provide mechanical overload protection for said centrifuge.

13. The centrifuge as recited in claim 12 wherein said gearbox comprises a maximum allowable torque rating and wherein said second value is said maximum allowable torque rating for said gearbox.

14. The centrifuge as recited in claim 12 further comprising at least one mechanical protection component arranged to provide said mechanical overload protection, wherein said at least one mechanical protection component is selected from the group consisting of an overload clutch and a limit switch.

15. A centrifuge for centrifuging a slurry, comprising:

a bowl;

a screw conveyor driven by a screw conveyor drive motor; and, an encoder operatively connected to said screw conveyor drive motor and arranged to enable operation of said screw conveyor drive motor in a range from a full positive maximum speed for the screw conveyor drive motor to a full negative maximum speed for the screw conveyor drive motor and in a range from zero torque output to 100 percent torque output for the screw conveyor drive motor.

* * * * *